United States Patent [19]

Ohbayashi et al.

[11] Patent Number: 4,745,049

[45] Date of Patent: May 17, 1988

[54] SILVER HALIDE PHOTOGRAPHIC LIGHT-SENSITIVE MATERIAL

[75] Inventors: Keiji Ohbayashi; Akiyoshi Tai; Noboru Mizukura, all of Hino, Japan

[73] Assignee: Konishiroku Photo Industry Co., Ltd., Tokyo, Japan

[21] Appl. No.: 35,653

[22] Filed: Apr. 7, 1987

[30] Foreign Application Priority Data

Apr. 11, 1986 [JP] Japan ..... 61-83855
Apr. 12, 1986 [JP] Japan ..... 61-84819

[51] Int. Cl.[4] ..... G03C 7/36; G03C 1/04; G03C 1/06

[52] U.S. Cl. ..... 430/546; 430/551; 430/556; 430/557

[58] Field of Search ..... 430/551, 556, 557, 607, 430/372, 546

[56] References Cited

U.S. PATENT DOCUMENTS 4,252,893 2/1981 Iwamuro et al. ..... 430/551
4,517,286 5/1985 Noguchi et al. ..... 430/546
4,656,125 4/1987 Renner et al. ..... 430/551

*Primary Examiner*—Paul R. Michl
*Assistant Examiner*—Mark R. Buscher
*Attorney, Agent, or Firm*—Bierman and Muserlian

[57] ABSTRACT

A silver halide photographic light-sensitive material improved in the color fastness of yellow dye images against light is disclosed. The photographic material comprises a silver halide emulsion layers containing a compound represented by General Formula [I] and a yellow coupler represented by General Formula [II]:

General Formula [I]

wherein J is an alkylene group, $R_1$ through $R_3$ are each substituents and n is an integer 1 to 3, General Formula [II]

wherein $R_{11}$ and $R_{12}$ are each a hydrogen atom or substituents and $R_{13}$ is a hydrogen atom or a substituent and $Z_1$ is a group capable of being splitted of from the coupler residue upon reaction of the coupler with the oxidized product of a color developing agent.

10 Claims, No Drawings

SILVER HALIDE PHOTOGRAPHIC LIGHT-SENSITIVE MATERIAL

FIELD OF THE INVENTION

This invention relates to a silver halide photographic light-sensitive material and, more particularly, to a silver halide photographic light-sensitive material further improved in the color fastness of yellow dye images against light.

BACKGROUND OF THE INVENTION

In the substractive color photography having normally been used for obtaining color images in the field of photographic technology, it is popularly known that a dye image is formed in such a process that an aromatic primary amine type color developing agent (hereinafter called simply a color developing agent) is used so as to develop exposed silver halide grains and to react the resulted oxidation products of the color developing agent and, thereby, the dye image is formed.

In the above-mentioned process, cyan, magenta and yellow dye images are ordinarily formed by making use of a phenol or naphthol type cyan coupler, a 5-pyrazolone, pyrazolino-imidazole, pyrazolotriazole, indazole or cyanacetyl type magenta coupler and an acylacetamide or dibenzoylmethane type yellow coupler, respectively.

It is desired that the dye images obtained in the above-mentioned manner are not to be faded and discolored even if the dye images are exposed to light for a substantially long time or the dye images are preserved in the conditions of high temperature and humidity. It is, however, well known that the color fastness of such dye images against rays of light including ultraviolet or visible rays still do not reach a satisfactory level, but the dye images are readily be faded and discolored when a light-sensitive material having such a dye image is irradiated by the rays of light active to the light-sensitive material. With the purpose of eliminating the above-mentioned disadvantages, there have so far been some proposals in which a coupler relatively less in fadability and discolorability is selected out, an ultraviolet ray absorbing agent is used so as to protect a dye image from ultraviolet rays, an antifading agent is used so as to prevent a dye image from fading caused by light and so forth.

For example, in the proposed method of improving a dye image in color fastness against light by adding and compounding an ultraviolet ray absorbing agent into a color light-sensitive material, the color fastness of a dye image against light may remarkably be improved more than in the case of not adding any ultraviolet ray absorbing agent. On the other hand, when using such a quantity of the ultraviolet ray absorbing agent as is sufficient to display an excellent effect, there arises such a disadvantage that a dye image may not be avoided from staining because the ultraviolet ray absorbing agent itself is tinted. Besides, even if such an ultraviolet ray absorbing agent is used, no color fading prevention effect can be displayed on any dye image faded by visible rays of light. There has accordingly been a limit in the improvement effects of ultraviolet ray absorbing agents on color fastness against light.

On the other hand, the antifading agents for preventing a color fading caused by rays of light include, for example, such a bisphenol as those described in Japanese Patent Examined Publications Nos. 31256/1973 and 31625/1973; a pyrogallol, a gallic acid and the esters thereof, such as those described in U.S. Pat. No. 3,069,262; an α-tocophenol and the acyl derivatives thereof, such as those described in U.S. Pat. No. 2,360,290 and Japanese Patent Publication Open to Public Inspection (hereinafter called Japanese Patent O.P.I. Publication) No. 27333/1976; such a 6-hydroxychroman as those described in U.S. Pat. Nos. 3,432,300 and 3,574,627; such a 5-hydroxychroman derivative as those described in U.S. Pat. No. 3,573,050; such a 6,6′-dihydroxy-2,2′-bisspirochroman as those described in Japanese Patent Examined Publication No. 20977/1974; such an organic metal chelated compound as those described in U.S. Pat. No. 4,050,938 and Japanese Patent O.P.I. Publication Nos. 62826/1979, 62987/1979, 82385/1979 and 82386/1979; such a 6,6′-dihydroxy-2,2′-bisspirochroman dialkylether as those described in Japanese Patent Examined Publication No. 19765/1982; such a hydroquinone dialkylether as those described in Japanese Patent Examined Publication No. 24257/1981; such a compound having a sterically hindered phenol group as those described in Japanese Patent O.P.I. Publication Nos. 48535/1979 and 222853/1985; and such a polyalkyl piperidine type compound as those described in Japanese Patent Examined Publication No. 20617/1982, Japanese Patent O.P.I. Publication Nos. 114036/1983, 119351/1984 and 116747/1984; and so forth.

Among the above-mentioned dye image stabilizers, the particularly preferable stabilizers against light for yellow dye images include, for example, the compounds each containing the above-mentioned sterically hindered phenol group and polyalkylpiperidine type compounds. Namely, with the compounds each containing the sterically hindered type phenol group or the polyalkylpiperidine type compound may be able to increase the color fastness against light of dye images without any deterioration caused by a preservation in the dark and, further, any undesirable discoloration (i.e., any stain) caused by light, heat or moisture.

On the other hand, however, when such compounds each containing the sterically hindered phenol groups (hereinafter abbreviated to HP) or such polyalkylpiperidine type compounds (hereinafter abbreviated to PAP) are used in an amount capable of sufficiently increasing in color stability against light, it was found that there were the disadvantages that the color developability of couplers were lowered and the gradation or maximum density was also lowered. The above-mentioned disadvantages are seriously emphasized particularly when carrying out a rapid processing or removing benzyl alcohol from a color developer with the purpose of preventing environmental pollutions.

In the meantime, when the above-mentioned HP or PAP is so limited to add as not to lower the color developability of couplers used under the above-mentioned development conditions, the stabilizing effect of these compounds will seriously be reduced.

SUMMARY OF THE INVENTION

This invention was achieved by taking the above-mentioned state of things into consideration.

It is, accordingly, a major object of the invention to provide a silver halide photographic light-sensitive material containing diffusion-proof couplers, which has, particularly, the sufficient color fastness of yellow dye images against light and does not deteriorate the color developability thereof.

The above-mentioned object of the invention can be achieved with a silver halide photographic light-sensitive material comprising a support bearing thereon at least one silver halide emulsion layer, wherein the emulsion layer contains at least one of the compounds each represented by the following General Formula [I] and at least one of the yellow couplers each represented by the following General Formula [II]:

General Formula [I]

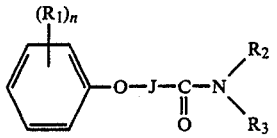

wherein $R_1$ is an alkyl or alkoxy group; J is an alkylene group having a straight or branched chain; $R_2$ and $R_3$ are each an alkyl group; n is an integer of from 1 to 3 and, when n is an integer of 2 or 3, the groups each represented by $R_1$ may be the same with or different from each other.

General Formula [II]

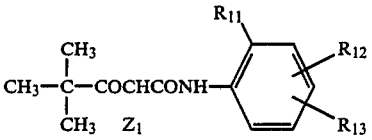

wherein $R_{11}$ is a halogen atom or an alkoxy group; $R_{12}$ is a hydrogen or halogen atom or an alkoxy group; $R_{13}$ is an acylamino, alkoxycarbonyl, alkylsulfamoyl, arylsulfamoyl, arylsulfonamido, alkylureido, arylureido, succinimido, alkoxy or aryloxy group; and $Z_1$ is a hydrogen atom or a group capable of being splitted off from a coupler residue upon reaction of the coupler reside with the oxidized product of a color developing agent.

DETAILED DESCRIPTION OF THE INVENTION

The constitution of the invention will now be described in detail below:

In the compounds of the invention each represented by the above-given General Formula [I], the alkyl groups each denoted by $R_1$ include, preferably, alkyl groups each having one to 18 carbon atoms and, more typically, a methyl group, an ethyl group, an n-butyl group, a t-butyl group, a t-amyl group, an n-hexyl group, an n-octyl group, a 2-ethylhexyl group, a decyl group, an octadecyl group and so forth.

The alkoxy groups each denoted by $R_1$ include, for example, a methoxy group, an ethoxy group, an n-buthoxy group, an n-octyloxy group, an n-dodecyloxy group and so forth.

The alkyl groups denoted by $R_2$ and $R_3$ are preferably the normal-chained or branch-chained alkyl groups each having one to 8 carbon atoms, such as a methyl group, an ethyl group, a butyl group, a hexyl group and so forth.

The alkylene groups each denoted by J are preferably the normal-chained or branch-chained alkylene groups each having one to 8 carbon atoms, such as the following groups:

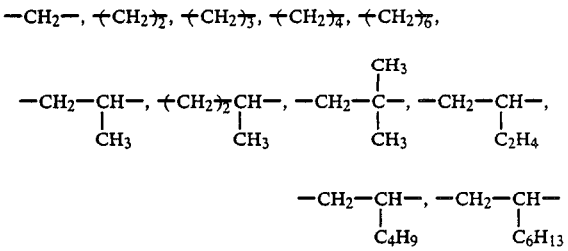

and so forth.

Typical examples of the compounds each represented by the General Formula [I] will be given below. It is, however, to be understood that this invention shall not be limited thereto.

[I-1]

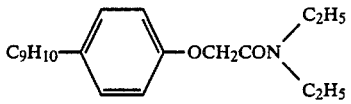

[I-2]

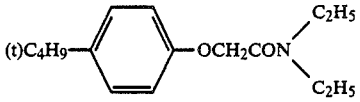

[I-3]

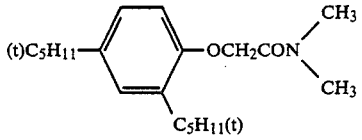

[I-4]

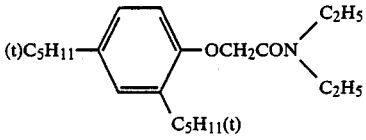

[I-5]

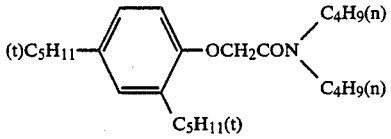

[I-6]

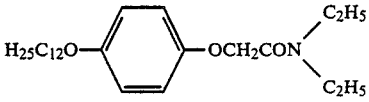

[I-7]

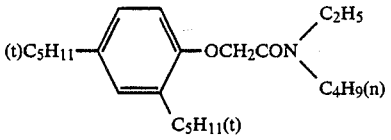

[I-8]

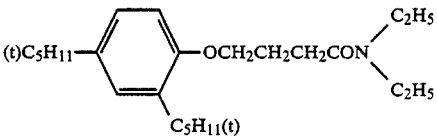

-continued
[I-9]
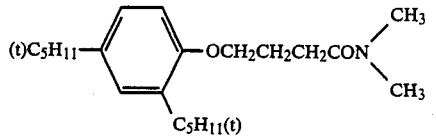
[I-10]
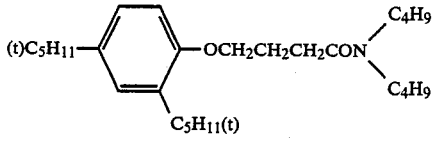
[I-11]
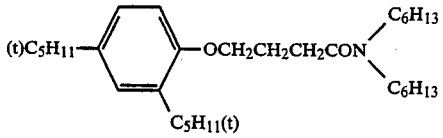
[I-12]
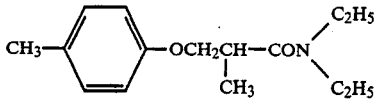
[I-13]
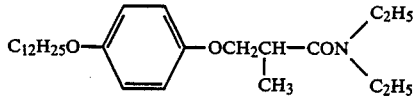
[I-14]
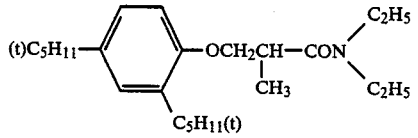
[I-15]
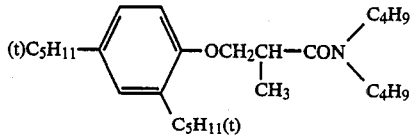
[I-16]
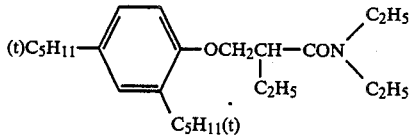
[I-17]
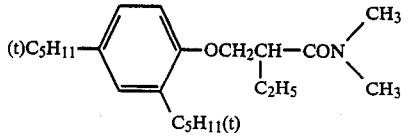
[I-18]
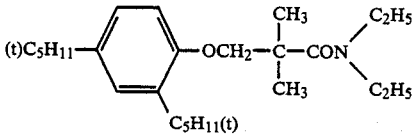
[I-19]
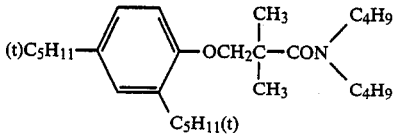
-continued
[I-20]
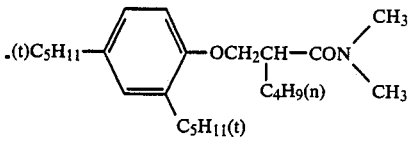
[I-21]
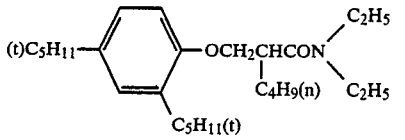
[I-22]
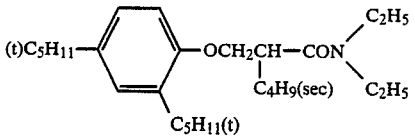
[I-23]
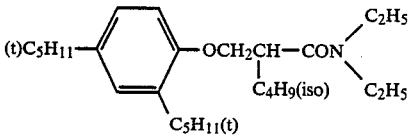
[I-24]
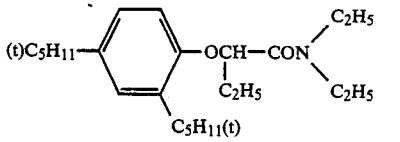
[I-25]
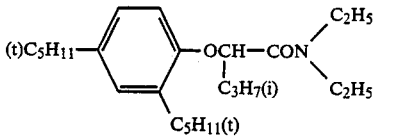
[I-26]
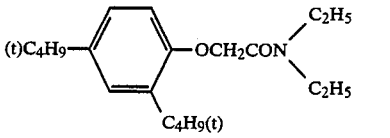
[I-27]
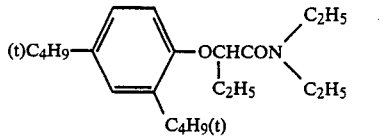
[I-28]
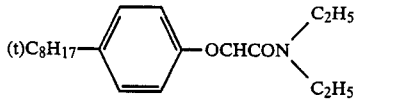
[I-29]
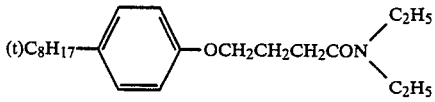
[I-30]
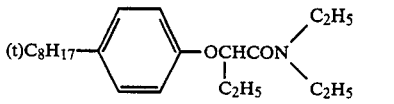

The compounds each represented by the aforegiven General Formula [I] may readily be synthesized in the various processes having so far been described in the technical literatures and so forth or in the similar processes thereto. Such compounds may readily be synthesized, in a well-known process, for example, through the reaction of anhydrous carboxylic acid with a compound containing an amino group, a carboxylic acid halide with a compound containing an amino group, or the like.

Concrete synthesis examples of the above-exemplified compounds will now be given below:

SYNTHESIS EXAMPLE 1 (SYNTHESIS OF COMPOUND EXAMPLE I-4)

A solution was prepared by adding 37 g of diethyl amine into 150 ml of chloroform and was then cooled down to −5° C. On the other hand, another solution was prepared by dissolving 62 g of 2,4-di-tert-amylphenoxyacetic acid-chloride into 50 ml of chloroform. The latter solution was dropped into the former solution. The resulting solution was kept at 0° C. or lower while the latter solution was being dropped and was then stirred up for two hours at room temperature. After the reaction was completed, the resulted chloroform layer was washed and was then dried up with anhydrous sodium sulfate. The resulted chloroform was distilled off under reduced pressure and the residues were recrystallized with 200 ml of n-hexane and, thereby a white crystallized objective matter was obtained. The structure of the objective matter was confirmed by making use of NMR, IR and Mass Spectrometries.

Yield: 47.2 g (at 68%)

Melting Point: 55° to 56° C.

SYNTHESIS EXAMPLE 2 (SYNTHESIS OF COMPOUND EXAMPLE I-24)

A solution was prepared by adding 37 g of diethyl amine into 150 ml of chloroform and was then cooled down to −5° C. On the other hand, another solution was prepared by dissolving 68 g of α-(2,4-di-tert-amylphenoxy)acetic acid-chloride into 50 ml of chloroform. The latter solution was dropped into the former solution. The resulting solution was kept at 0° C. while the latter solution was being dropped and was then stirred up for two hours at room temperature. After the reaction was completed, the resulted chloroform layer was washed and was then dried up with anhydrous sodium sulfate. The resulted chloroform was distilled off under reduced pressure and the resulted residues were distilled under reduced pressure and, thereby a transparent liquid objective matter was obtained. The structure of the objective matter was confirmed by making use of NMR, IR and Mass Spectrometries.

Yield: 58.9 g (at 78%)

Melting Point: 165° to 167° C./1.5 mmHg

The yellow couplers of the invention each represented by General Formula [II] include the well-known pivaloylacetanilido type yellow couplers. Particularly in the case of using the yellow couplers each represented by the following General Formula [IIa], the effects of the invention can remarkably be displayed. Namely, in the case of processing with a color developer not containing any benzyl alcohol, both density and contrast can be endowed highly and, in addition, the color fastness against light of yellow dye images can be improved with a leap by making use of the compounds each represented by General Formula [I].

General Formula [IIa]

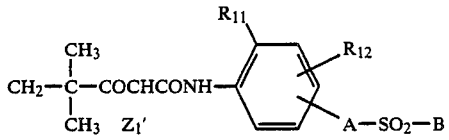

wherein A represents a simple link, —$NR_{14}$—, —$NR_{14}COR_{15}$—,

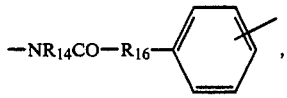

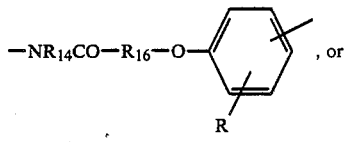

, or

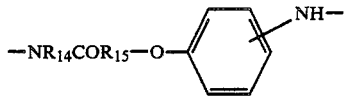

in which $R_{14}$ represents a hydrogen atom or an alkyl group such as a methyl, ethyl, dodecyl or like group which may have a substituent. Such substituents shall not specifically be limited to use, however, the typical ones include, for example, a halogen atom such as a fluorine, chlorine, bromine or iodine atom, an alkyl group such as a methyl, ethyl, t-butyl or octyl group, an aryl group such as a phenyl, p-chlorophenyl, p-methoxyphenyl, p-dodecylphenyl or naphthyl group, an alkoxy group such as a methoxy, ethoxy, t-butoxy, benzyloxy or dodecyloxy group, an aryloxy group such as a phenoxy group, an alkylthio group such as an ethylthio or hexylthio group, an arylthio group, such as a phenylthio group, an alkylsulfonyl group such as a β-hydroxyethylsulfonyl or dodecylsulfonyl group, an arylsulfonyl group such as a phenylsulfonyl group, an acylamino group, a carbamoyl group, an acyl group, a sulfonamido group, a sulfamoyl group, a nitrile group and so forth;

$R_{15}$ and $R_{16}$ represent each an alkylene group which may have a substituent such as those given to the alkyl groups each denoted by the $R_{14}$. The typical substituents include, for example, a methylene, ethylene, 2-phenylethylene, p-chlorophenylmethylene or like group;

R represents such a substituent as a hydrogen atom, an alkoxycarbonl group such as a methoxycarbonyl group and the like groups) and so forth;

B represents an alkyl group which may have a substituent such as an ethyl, propyl, dodecyl or like group, an aryl group such as a phenyl, dodecylphenyl, dodecyloxyphenyl or like group, a heterocyclic group such as a pyridyl, pyrazinyl, furyl or like group, an aryloxy group, or the groups each represented by the General Formula,

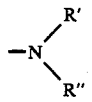

in which R′ and R″ represent each an alkyl or acyl group which may be substituted and, the substituents to the above-mentioned alkyl, aryl, heterocyclic and aryloxy groups and the compounds represented by

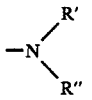

include, for example, the groups given to the substituents to the alkyl groups denoted by the above-given $R_{14}$;

$Z_1$, represents a hydrogen atom or a group capable of being splitted off upon reaction of coupler residue with the oxidation products of a color developing agent and, preferably, a group capable of linking with the coupler residue through an oxygen atom, a nitrogen atom or a sulfur atom and, more concretely, a group selected from the group consisting of the following groups:

(a) $—OCOR_{17}$, (wherein $R_{17}$ represents an alkyl, alkenyl or aryl group including those each having a substituent);

(b) $—OCOR_{18}$, (wherein $R_{18}$ represents an alkyl, aryl or heterocyclic group including those each having a substituent);

(c) $—O—R_{19}$, (wherein $R_{19}$ represents an aryl group including those each having a substituent);

(d)

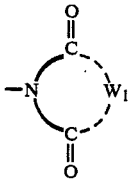

(wherein $W_1$ represents a group of non-metal atoms necessary for forming a saturated or unsaturated 4-, 5- or 6-membered ring and such rings may have a substituent);

(e)

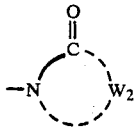

(wherein $W_2$ represents a group of non-metal atoms necessary for forming a saturated or unsaturated 4-, 5- or 6-membered ring, and such rings may have a substituent);

(f)

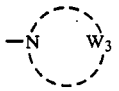

(wherein $W_3$ represents a group of non-metal atoms necessary for forming a saturated or unsaturated 4-, 5- or 6-membered ring, and such rings may have a substituent); and (g) $—S—R_{20}$ (wherein $R_{20}$ represents an alkyl, alkenyl, aryl or heterocyclic group each of which may have a substituent).

Now, the typical examples of the above-mentioned groups each capable of being splitted off in the course of a color developing step will be given.

$—OCOCH_3$ (S-1)

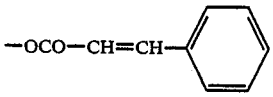
(S-2)

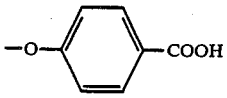
(S-3)

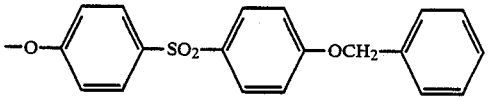
(S-4)

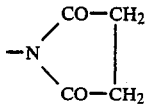
(S-5)

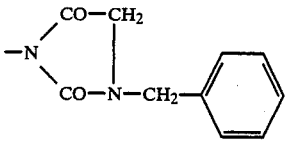
(S-6)

$—OCOC_{10}H_{23}$ (S-7)

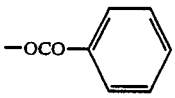
(S-8)

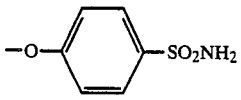
(S-9)

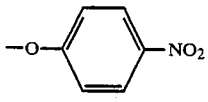
(S-10)

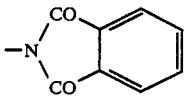
(S-11)

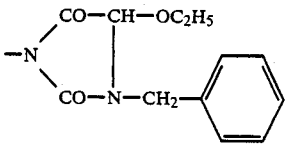
(S-12)

-continued
(S-13)
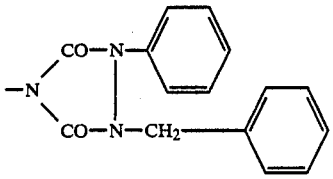
(S-14)
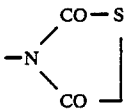
(S-15)
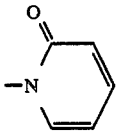
(S-16)
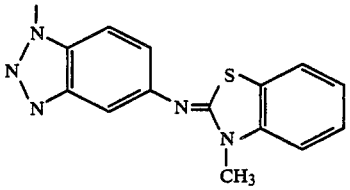
(S-17)
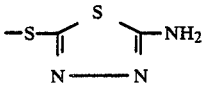
(S-18)
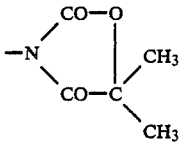
(S-19)
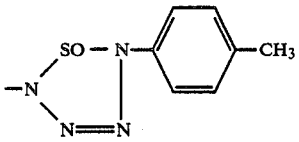
(S-20)
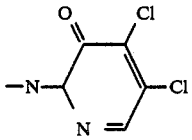
(S-21)
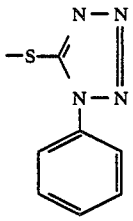
(S-22)
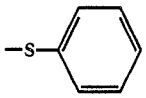
-continued
(S-23)
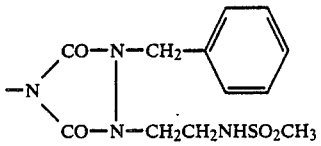
(S-24)
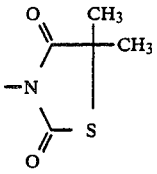
(S-25)
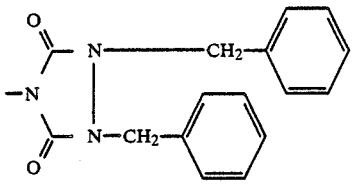
(S-26)
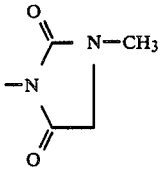
(S-27)
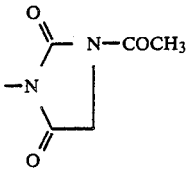
(S-28)
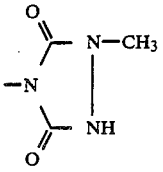
(S-29)
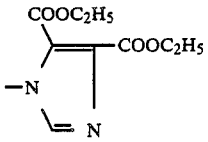
(S-30)
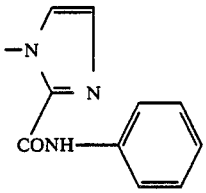
(S-31)
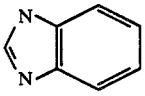
(S-32)
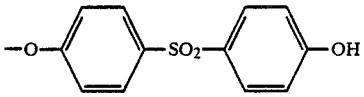

-continued (S-33)

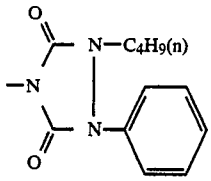

(S-34)

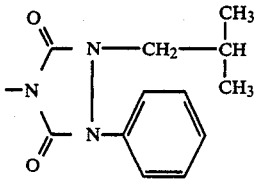

(S-35)

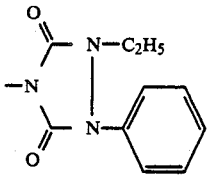

(S-36)

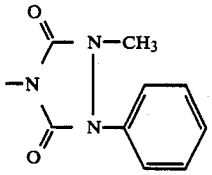

-continued (S-37)

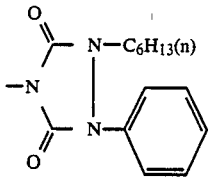

The yellow couplers of the invention also prepferably include a bis-type compound which is comprised of the above-mentioned splitting-off group having a structure in which $Z_{1'}$ is removed from the aforegiven General Formula [IIa]. Such bis-type compounds may be represented by the following General Formula [IIb]:

General Formula [IIb]

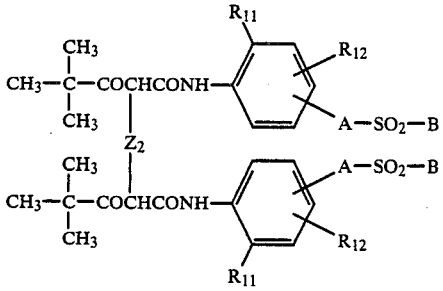

(wherein $Z_2$ represents a divalent linking group necessary to couple a two-molecoular type pivaloylacetanilido coupler so as to form a bis-type coupler in an active site substituting position.)

Next, the typical examples of the above-mentioned divalent coupling groups each represented by W will be given below:

(S-38)

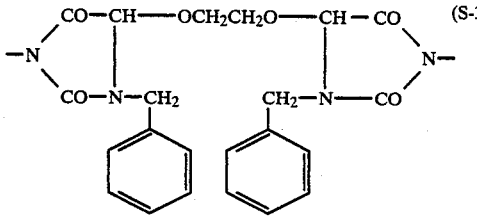

(S-39)

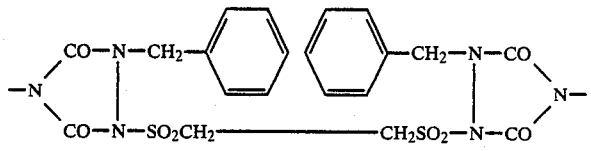

(S-40)

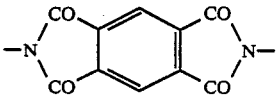

(S-41)

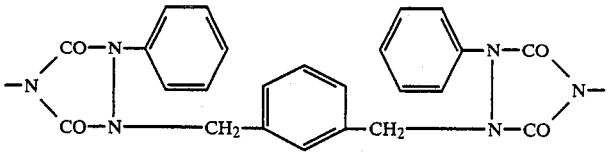

(S-42)

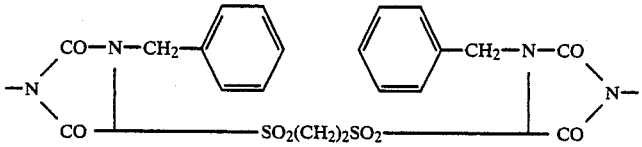

(S-43)

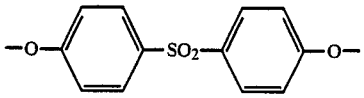

(S-44)

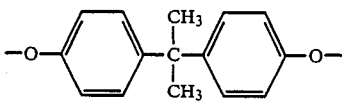

Next, the typical examples of the yellow couplers of the invention will be given in the following Tables and, it is, however, to be understood that the invention shall not be limited thereto. Such typical examples are given by the substituents in the above-given General Formula [IIa] or [IIb] and the numerals in parentheses in the columns of the substituents indicate the coupling positions, respectively.

| No. | $Z_1'$ | $R_{11}$ | $R_{12}$ | A | B |
|---|---|---|---|---|---|
| Y-1 | S-13 | —Cl | —H | $-NHCO\underset{\underset{CH_3}{\vert}}{C}HCH_2-$ (5) | $-C_{12}H_{25}$ |
| Y-2 | Y-13 | —Cl | —H | $-NHCOCH_2CH_2-$ (5) | $-C_{12}H_{25}$ |
| Y-3 | S-6 | —Cl | —H | $-NHCO\underset{\underset{CH_3}{\vert}}{C}H-CH_2$ (5) | $-C_{12}H_{25}$ |
| Y-4 | S-25 | —Cl | —H | $-NHCOCH_2\underset{\underset{C_{11}H_{23}}{\vert}}{C}H-$ (5) | 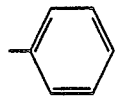 |
| Y-5 | S-6 | —Cl | —H | $-NHCO\overset{\overset{CH_3}{\vert}}{\underset{\underset{CH_3}{\vert}}{C}}-$ (5) | $OC_{12}H_{25}$ |
| Y-6 | S-13 | —Cl | —H | $-NHCO\overset{\overset{CH_3}{\vert}}{\underset{\underset{CH_3}{\vert}}{C}}-$ (5) | 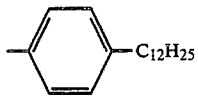 |
| Y-7 | S-13 | —Cl | —H | $-NHCO\underset{\underset{CH_3}{\vert}}{C}H-CH_2-$ (5) | 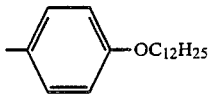 |
| Y-8 | S-13 | —Cl | —H | $-NHCO\underset{\underset{CH_3}{\vert}}{C}HCH_2-$ (5) | 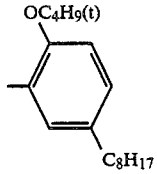 |
| Y-9 | S-18 | —Cl | —H | 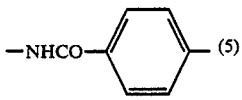 | $-C_{12}H_{25}$ |
| Y-10 | Y-13 | —Cl | —H | $-NHCO\underset{\underset{CH_3}{\vert}}{C}HCH_2CH_2-$ (5) | 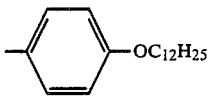 |
| Y-11 | S-13 | —Cl | —H | $-NHCOCH_2CH_2-$ (5) | $-CH_2CH_2SO_2C_{12}H_{25}$ |
| Y-12 | S-6 | —Cl | —H | 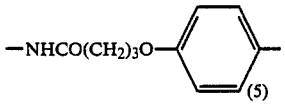 | 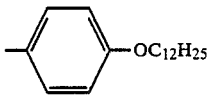 |
| Y-13 | S-28 | —Cl | —H | 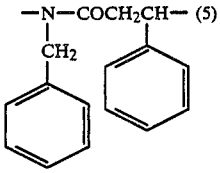 | $-C_{12}H_{25}$ |

-continued

| No. | $Z_1'$ | $R_{11}$ | $R_{12}$ | A | B |
|---|---|---|---|---|---|
| Y-14 | S-18 | —F | —$CH_3$ (4) | —NH— (5) | 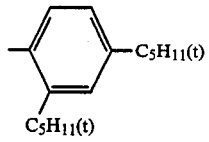 |
| Y-15 | S-13 | —Cl | —H | —NH— (5) | 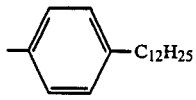 |
| Y-16 | S-13 | —Cl | —H | —NH— (5) | 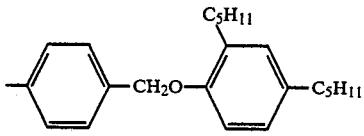 |
| Y-17 | S-13 | —Cl | —H | —NH— (5) | 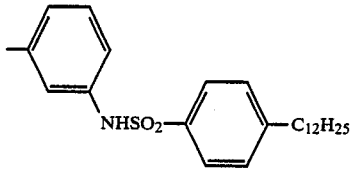 |
| Y-18 | S-13 | —Cl | —H | —NH— (5) | 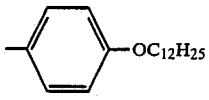 |
| Y-19 | S-18 | —Cl | —Cl (4) | —NH— (5) | —$C_{12}H_{25}$ |
| Y-20 | S-4 | —Cl | —H | — (5) | —$NHC_{16}H_{33}$ |
| Y-21 | S-43 | —Cl | —H | —NH— (5) | —$C_{16}H_{33}$ |
| Y-22 | S-33 | —Cl | —H | —NHCO$\underset{\underset{CH_3}{\vert}}{C}$HCH$_2$— (5) | —$C_{12}H_{25}$(n) |
| Y-23 | S-34 | —Cl | —H | —NHCO$\underset{\underset{CH_3}{\vert}}{C}$HCH$_2$— (5) | —$C_{12}H_{25}$(n) |
| Y-24 | S-35 | —Cl | —H | —NHCO$\underset{\underset{CH_3}{\vert}}{C}$HCH$_2$— (5) | —$C_{12}H_{25}$(n) |

Exemplified Compounds for the yellow couplers represented by General Formula [II] other than General Formulas [IIa] and [IIb]:

| Coupler | $Z_1$ | $R_{11}$ | $R_{12}$ | $R_{13}$ |
|---|---|---|---|---|
| Y-25 | S-4 | —Cl | —H | —NHCO$(CH_2)_3$O—(BL-1)* (5) |
| Y-26 | S-6 | —Cl | —H | —NHCO$(CH_2)_3$O—(BL-1) (5) |
| Y-27 | S-6 | —Cl | —H | —NHCO$\underset{\underset{CH_3}{\vert}}{C}$HCH$_2$O—(BL-1) (5) |
| Y-28 | S-6 | —Cl | —H | —COO$\underset{\underset{CH_3}{\vert}}{C}$HCOO$C_{12}H_{25}$ (5) |
| Y-29 | S-6 | —Cl | —H | —COO$C_{12}H_{25}$ (5) |
| Y-30 | S-6 | —Cl | —H | —COO$\underset{\underset{C_4H_{9(n)}}{\vert}}{C}$HCOO$C_{12}H_{25}$ (5) |

-continued

| Coupler | $Z_1$ | $R_{11}$ | $R_{12}$ | $R_{13}$ |
|---|---|---|---|---|
| Y-31 | S-6 | —Cl | —H | —NHCO$\underset{\underset{CH_3}{\vert}}{\overset{\overset{CH_3}{\vert}}{C}}$—CH$_2$O—(BL-1) (5) |
| Y-32 | S-12 | —Cl | —H | —NHCO$(CH_2)_5$—O—(BL-1) (5) |
| Y-33 | S-12 | —$OCH_3$ | —H | —NHCO$(CH_2)_3$O—(BL-1) (5) |
| Y-34 | S-13 | —Cl | —H | —NHCO$(CH_2)_3$O—(BL-1) (5) |
| Y-35 | S-13 | —Cl | —H | —COO$\underset{\underset{C_2H_5}{\vert}}{C}$HCOO$C_{12}H_{25}$(5) |
| Y-36 | S-13 | —Cl | —H | —COO$C_{12}H_{25}$ (5) |
| Y-37 | S-34 | —Cl | —H | —NHCO$(CH_2)_3$O—(BL-1) (5) |
| Y-38 | S-34 | —Cl | —H | —NHCO$\underset{\underset{C_2H_5}{\vert}}{C}$HO—(BL-1) (5) |
| Y-39 | S-34 | —Cl | —H | —COO$C_{12}H_{25}$ |

-continued

| Coupler | $Z_1$ | $R_{11}$ | $R_{12}$ | $R_{13}$ |
|---|---|---|---|---|
| Y-40 | S-34 | —Cl | —H | $-COOCH(C_2H_5)COOC_{12}H_{25}$ (5) |
| Y-41 | S-33 | —Cl | —H | $-NHCOC(CH_3)_2-CH_2O-$(BL-1) (5) |

*BL-1: 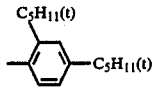

In the yellow couplers each represented by the aforegiven General Formula [IIa] or [IIb], the non-split-off group thereof has a $—SO_2—$ structure. Such yellow couplers can render both substantially high maximum density and contrast to images and endow yellow dye images with a relatively high color fastness, even if they are processed with a color developer not containing any benzyl alcohol. On the contrary, they have such a disadvantage as is liable to produce yellow stains by heat or moisture.

When using the compounds each represented by the aforegiven General Formula [I] and the yellow couplers each represented by the General Formula [IIa] or [IIb] in combination, the above-mentioned disadvantage can be improved so as to display the amazing effects that a dye stability against light can be increased and any lowering in color developability cannot be derived therefrom.

In this invention, it is preferred, from the viewpoint of the color fastness of yellow dye images against light, a yellow dye image forming layer contains a compound having a sterically hindered phenol group (HP) and/or a polyalkylpiperidine group (PAP).

In the case of only using a yellow coupler of the invention and a compound represented by General Formula [I] in a yellow dye image forming layer, the compound represented by General Formula [I] can display an excellent color stabilization effect against light in the stage where a color is not yet much faded against light, that is, in the stage of an initial fading stage and, on the contrary, such an affect is liable to lower in the stage where the fading is relatively increased.

In the case of adding the above-mentioned HP and/or PAP into a yellow dye image forming layer, there is an advantage capable of satisfactorily keeping the color stabilization effect of the compounds each represented by General Formula [I] against light.

The compounds each containing the sterically hindered phenol group (HP), which are preferably used in the light-sensitive materials of the invention, are those each containing, in the molecular structure thereof, at least one of the phenol groups each represented by the following General Formula [III]:

General Formula [III]

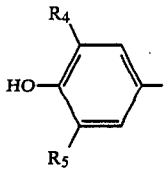

Wherein $R_4$ and $R_5$ represent each a normal-chained or branch-chained alkyl group having 3 to 8 carbon atoms, respectively, which include, for example, a t-butyl group, a t-pentyl group and so forth.

The HPs which may more preferably be used in the invention include, for example, the compounds each represented by the following General Formula [IIIa]:

General Formula [IIIa]

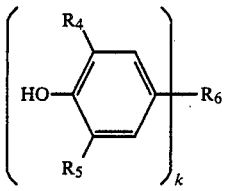

Wherein $R_4$ and $R_5$ are synonymous with the $R_4$ and $R_5$ denoted in the aforegiven General Formula [III], respectively; and $R_6$ represents a k-valent organic group in which k is an integer of from 1 to 6.

The k-valent organic groups each represented by $R_6$ include, for example, such an alkyl group as a methyl group, an ethyl group, a propyl group, a butyl group, a pentyl group, an octyl group, a hexadecyl group, a methoxyethyl group, a chloromethyl group, an 1,2-dibromethyl group, a 2-chlorethyl group, a benzyl group, a phenethyl group and so forth; such an alkenyl group as an allyl group, a propenyl group, a butenyl group and so forth; such a polyvalent unsaturated hydrocarbon group as an ethylene group, a trimethylene group, a propylene group, a hexamethylene group, a 2-chlorotrimethylene group and so forth; such an unsaturated hydrocarbon group as a glyceryl group, a diglyceryl group, a pentaerythrityl group, a dipentaerythrityl group and so forth; such an alicyclic hydrocarbon group as a cyclopropyl group, a cyclohexyl group, a cyclohexenyl group and so forth; such an aryl group as a phenyl group, a p-octylphenyl group, a 2,4-dimethylphenyl group, a 2,4-di-t-butylphenyl group, a 2,4-di-t-pentylphenyl group, a p-chlorophenyl group, a 2,4-dibromophenyl group, a naphthyl group and so forth; such an arylene group as an 1,2-1,3- or 1,4-phenylene group, a 3,5-dimethyl-1,4-phenylene group, a 2-t-butyl-1,4-phenylene group, a 2-chloro-1,4-phenylene group, a naphthalene group and so forth; such an 2,4,6-three-position-substituted phenyl group; and so forth.

Besides the above-given groups, $R_6$ further include k-valent organic groups each coupled to any one of the above-given groups through an —O—, —S— or $—SO_2—$ group.

$R_6$ include, more preferably, a 2,4-di-t-butylphenyl group, a 2,4-di-t-pentylphenyl group, a p-octylphenyl group, a p-dodecylphenyl group, a 3,5-di-t-butyl-4-hydroxylphenyl group and a 3,5-di-t-pentyl-4-hydroxylphenyl group.

k is preferably an integer of from 1 to 4.

Typical examples of the compounds each containing steric hindrance type phenol group may be given below. It is, however, to be understood that the invention shall not be limited thereto.
III-1
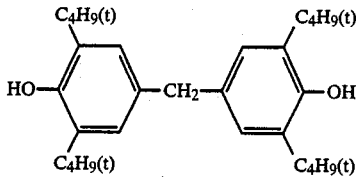
III-2
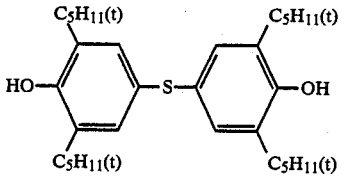
III-3
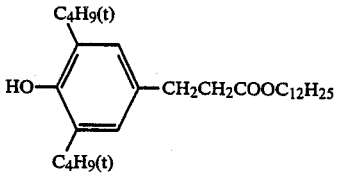
III-4
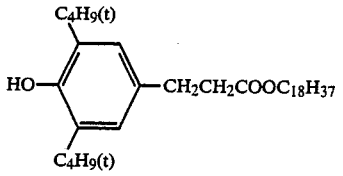
III-5
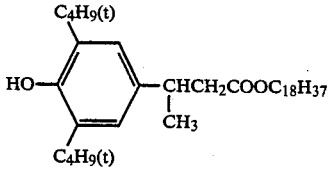
III-6
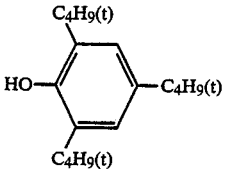
III-7
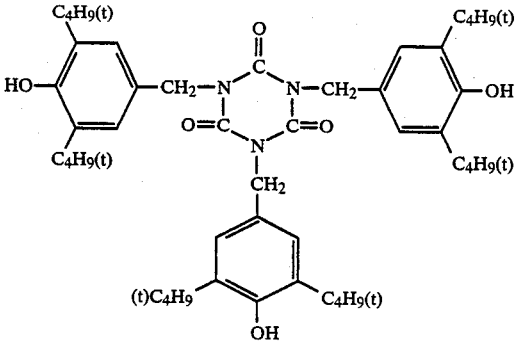
-continued
III-8
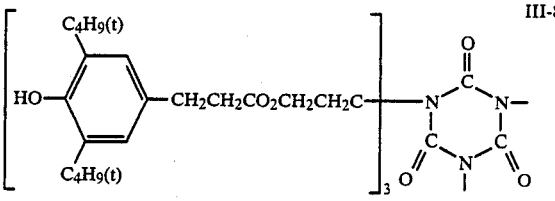
III-9
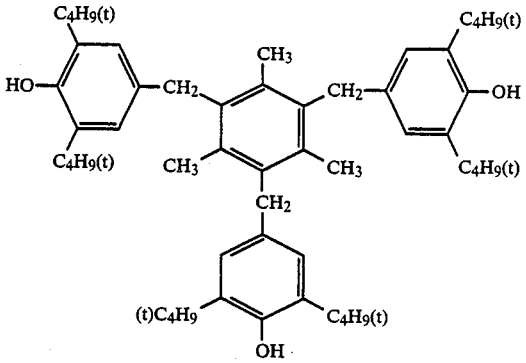
III-10
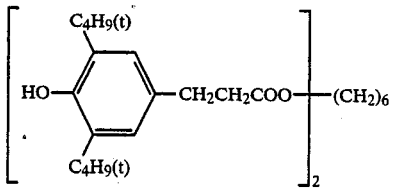
III-11
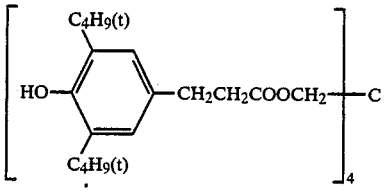
III-12
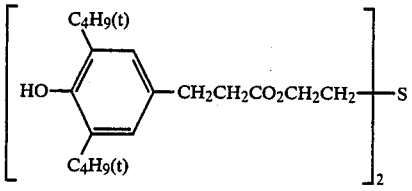
III-13
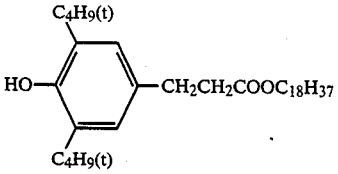
III-14
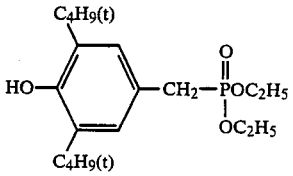

-continued
III-15
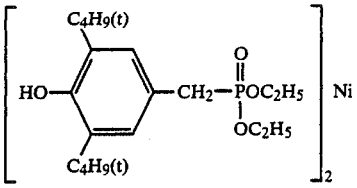
III-16
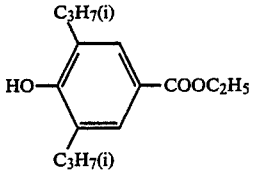
III-17
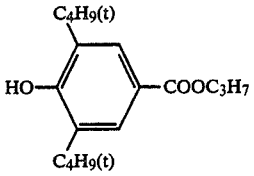
III-18
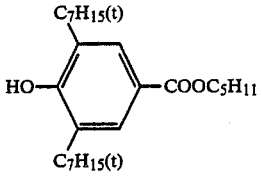
III-19
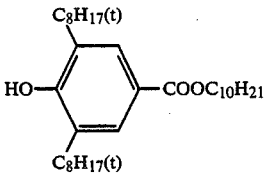
III-20
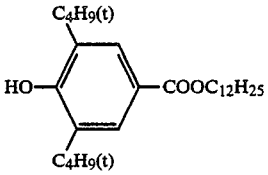
III-21
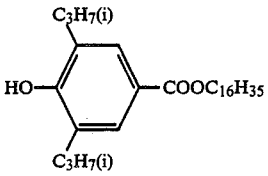
III-22
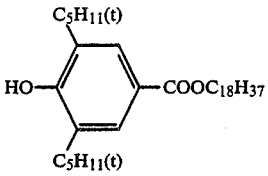
III-23
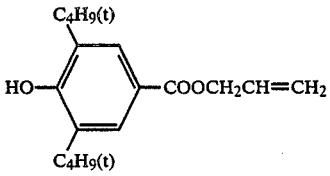
-continued
III-24
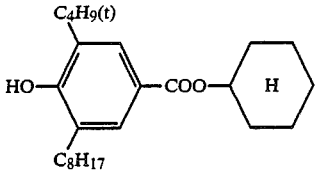
III-25
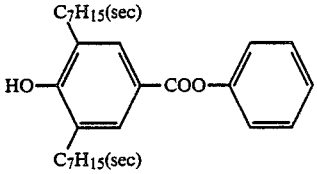
III-26
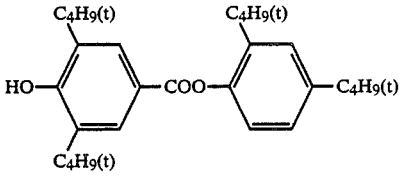
III-27
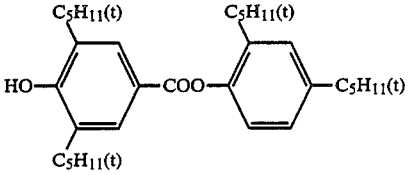
III-28
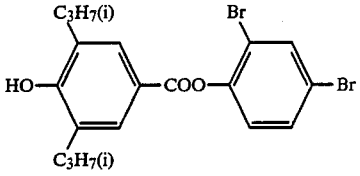
III-29
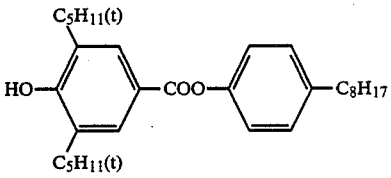
III-30
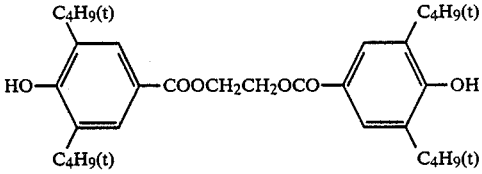
III-31
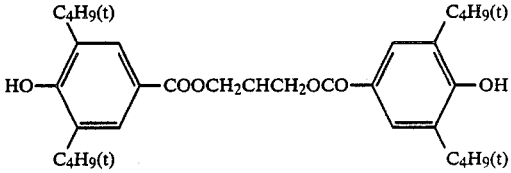

-continued
III-32
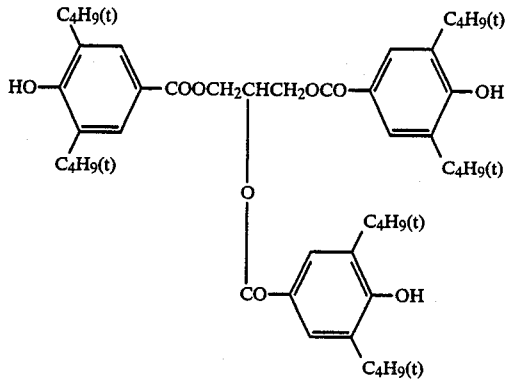
III-33
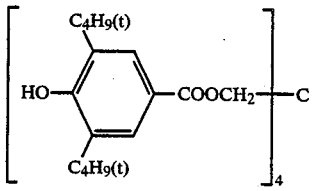
III-34
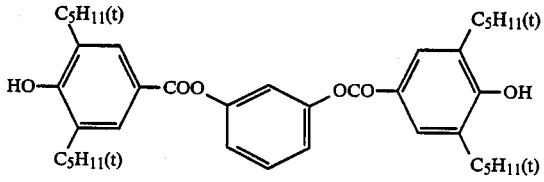
III-35
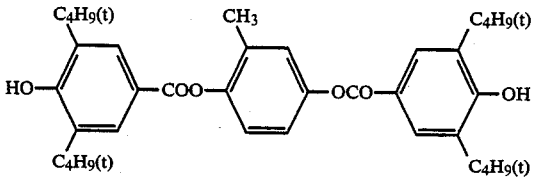
III-36
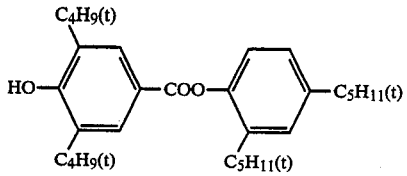
III-37
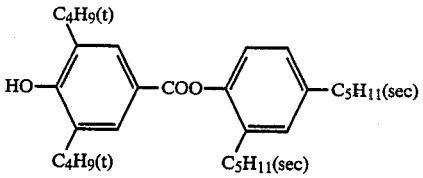
III-38
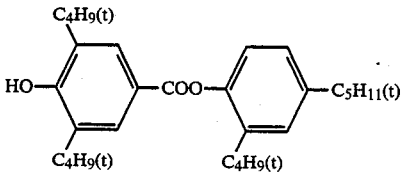
-continued
III-39
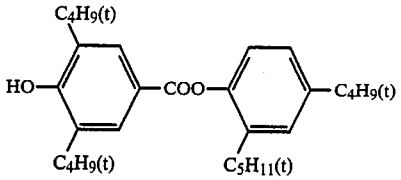
III-40
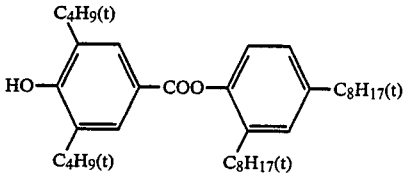
III-41
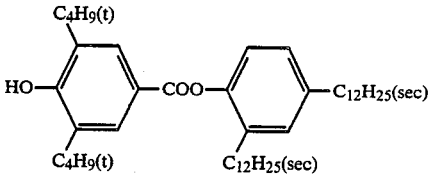
III-42
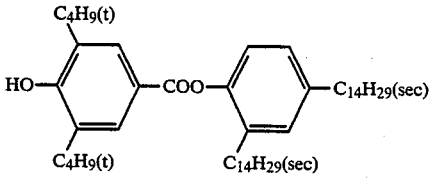
III-43
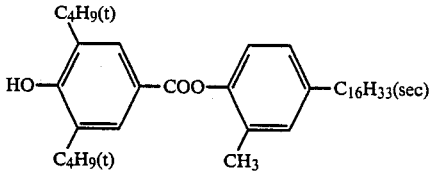
III-44
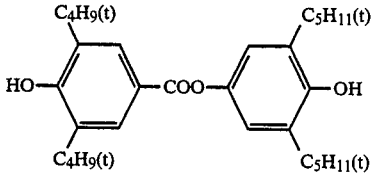
III-45
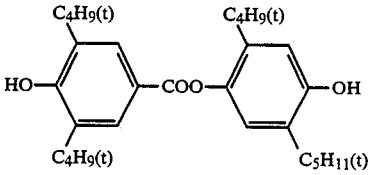
III-46
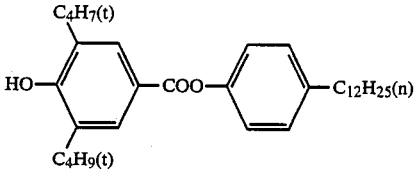
III-47
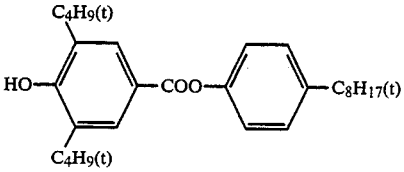

-continued

III-48

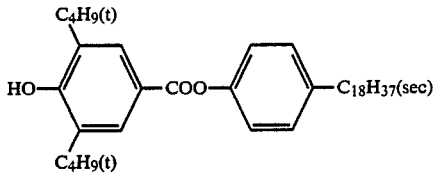

III-49

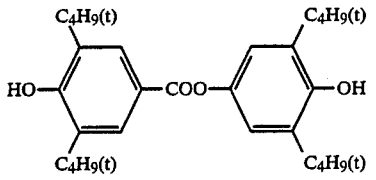

The polyalkylpiperidine type compounds (PAP) used in the invention are the compounds each having, in the molecular structure thereof, at least one polyalkylpiperidine group represented by the following General Formula [IV]:

General Formula [IV]

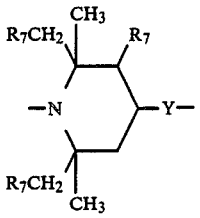

Wherein $R_7$ represents a hydrogen atom or an alkyl group which is preferably a methyl group; Y represents an —O— group or a

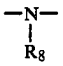

group in which $R_8$ represents a hydrogen atom, an alkyl group, an aryl group or an acyl group.

The particularly preferable PAP used in the invention are the compounds each represented by the following General Formula [IVa]:

General Formula [IVa]

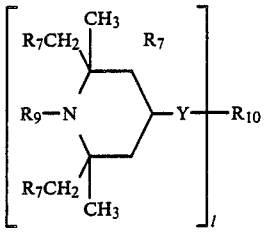

Wherein $R_7$ and Y are synonymous with the $R_7$ and Y each denoted in the aforegiven General Formula [IV], respectively; and $R_{10}$ represents an l-valent organic group in which l is an integer of from 1 to 4.

$R_9$ represents an alkyl group such as a methyl group, an ethyl group, a propyl group, a butyl group, a pentyl group, a benzyl group, and so forth; an alkenyl group such as a vinyl group, an allyl group, an isopropenyl group and so forth; an alkynyl group such as an ethynyl group, a propynyl group and so forth; or an acyl group such as a formyl group, an acetyl group, a propionyl group, a butylyl group, an acryloyl group, a propioloyl group, a methacryloyl group, a crotonoyl group and so forth.

The more preferable $R_9$ include, for example, a methyl group, an ethyl group, a vinyl group, an allyl group, a propynyl group, a benzyl group, an acetyl group, a propionyl group, an acryloyl group, a methacryloyl group and crotonoyl group.

The polyalkylpiperidine type compounds used in the invention include, for example, the following compounds may be given as the typical examples:

IV-1

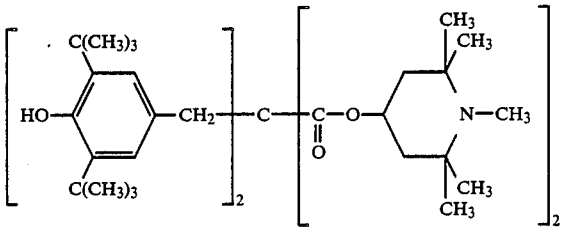

IV-2

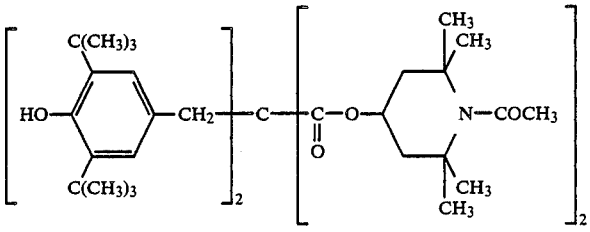

-continued
IV-3
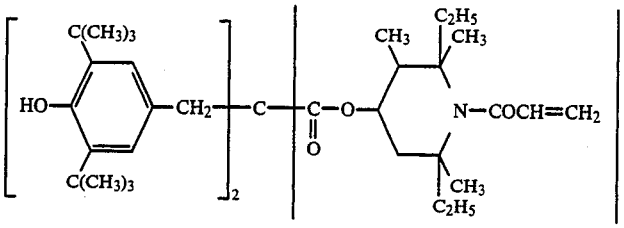
IV-4
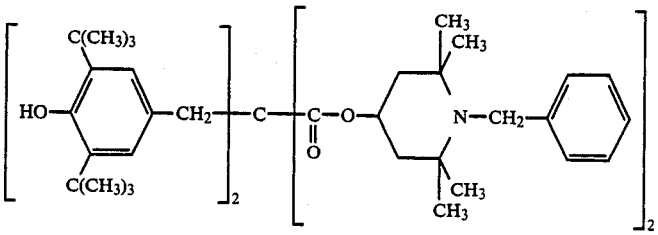
IV-5
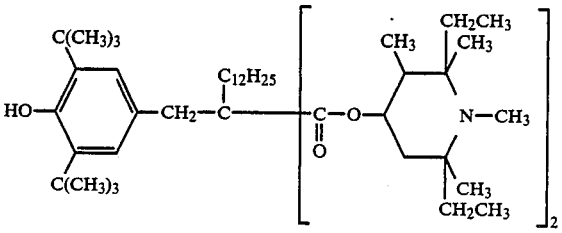
IV-6
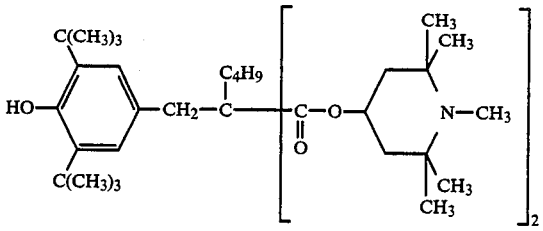
IV-7
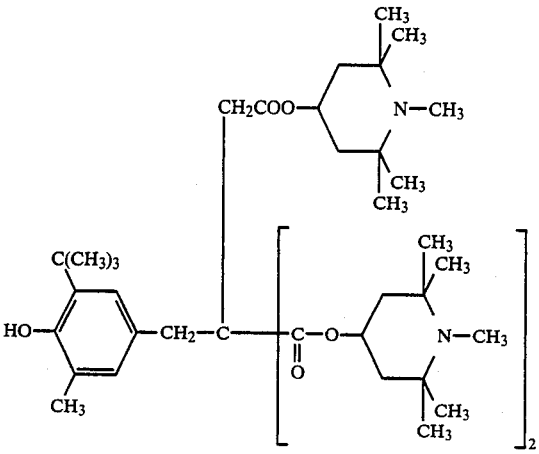

-continued
IV-8
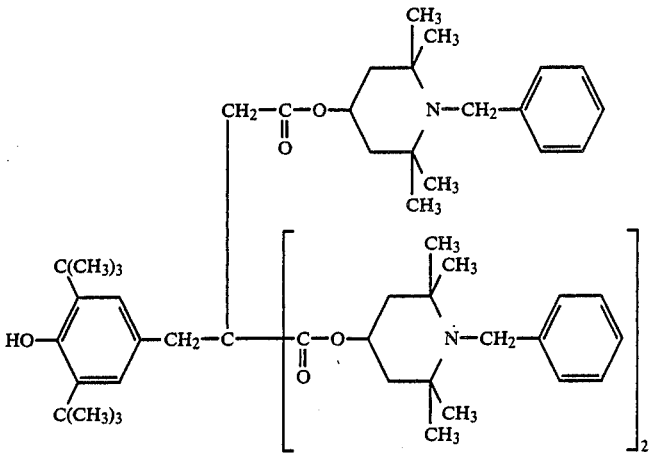
IV-9
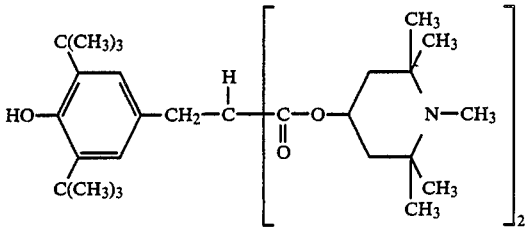
IV-10
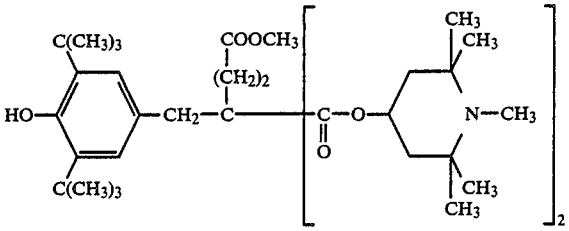
IV-11
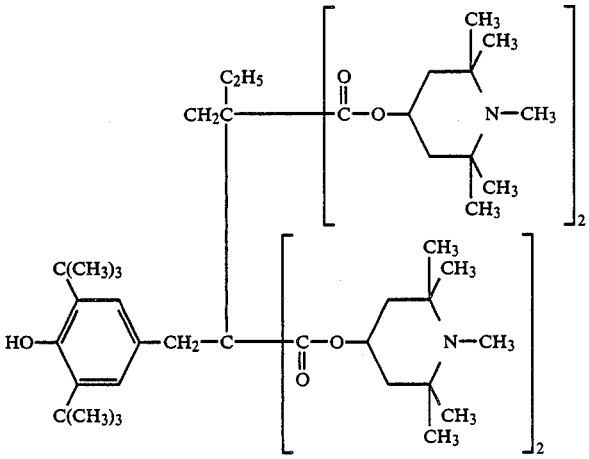

-continued
IV-12
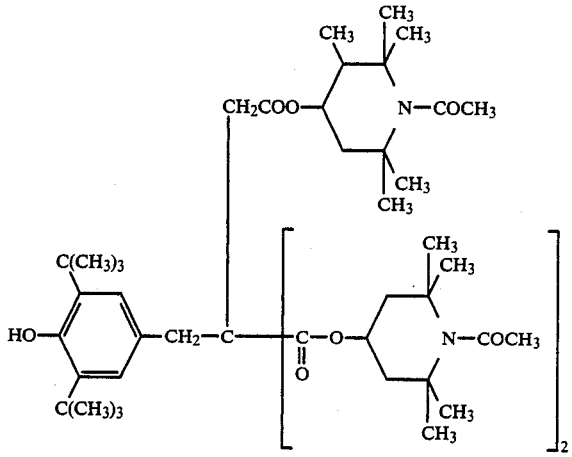
IV-13
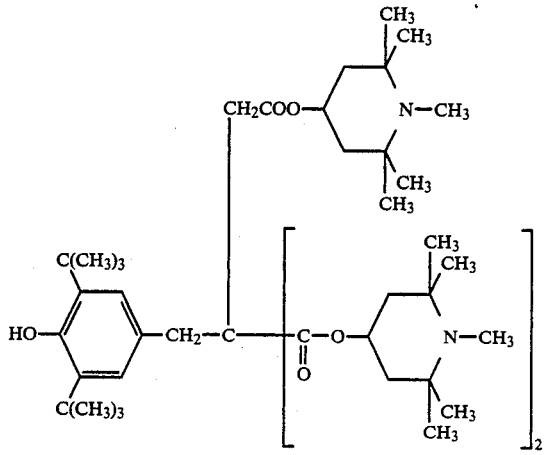
IV-14
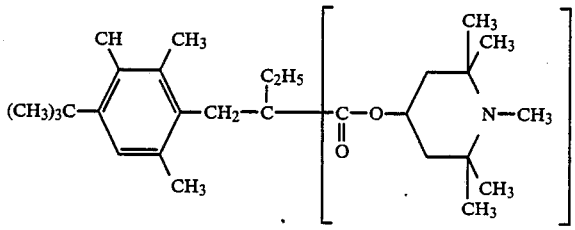
IV-15
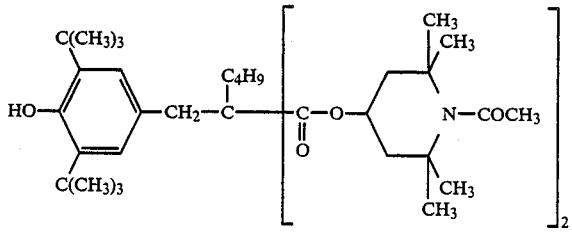
IV-16
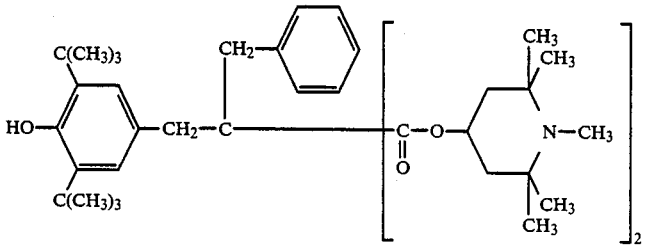

-continued
IV-17
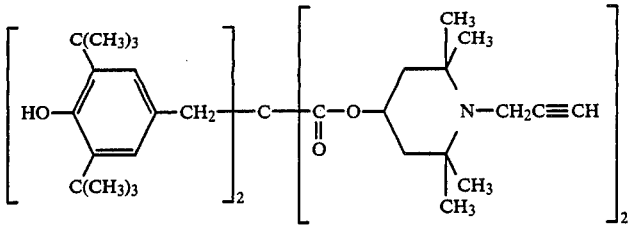
IV-18
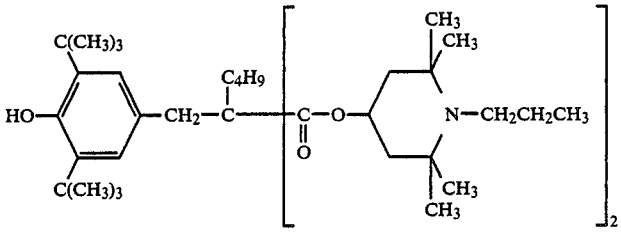
IV-19
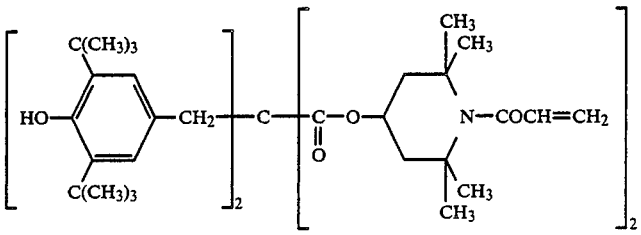
IV-20
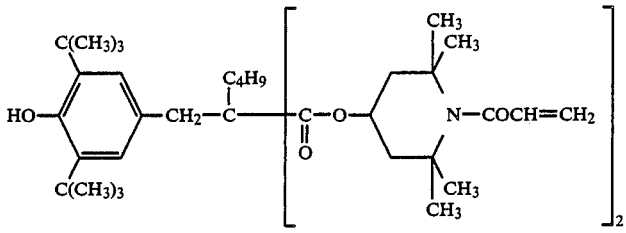
IV-21
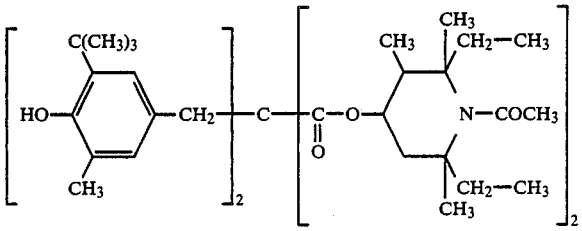
IV-22
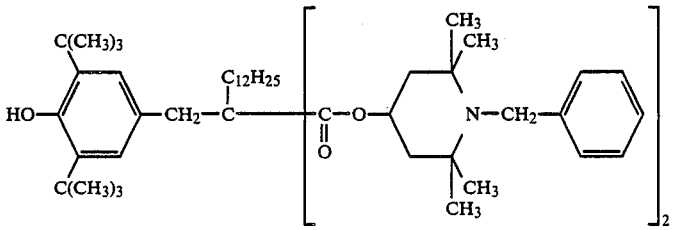

-continued
IV-23
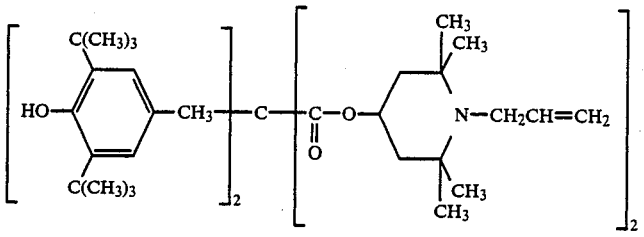
IV-24
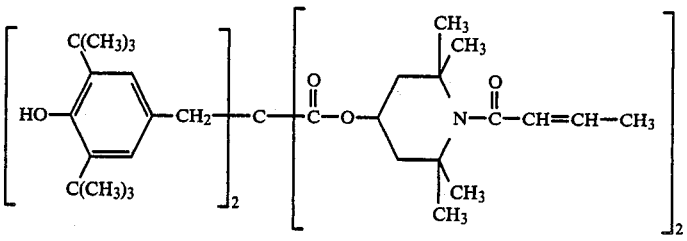
IV-25
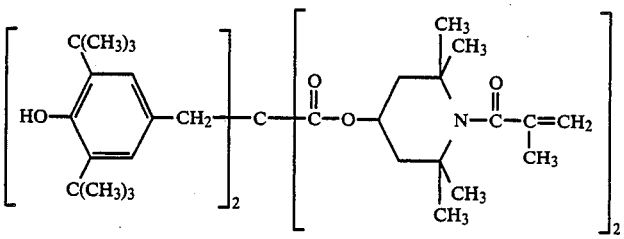
IV-26
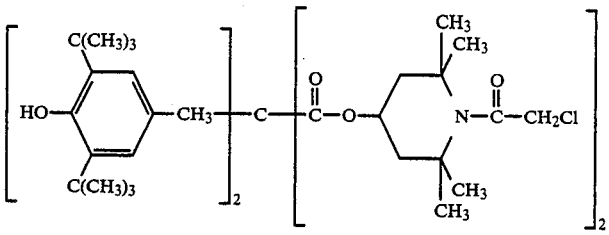
IV-27
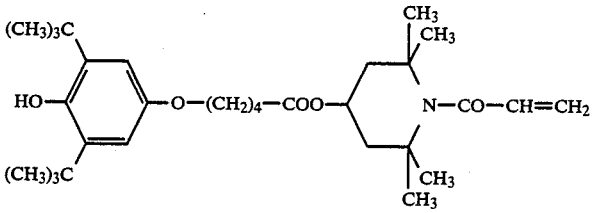
IV-28
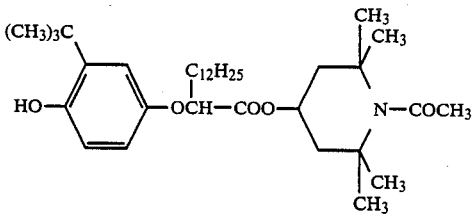
IV-29
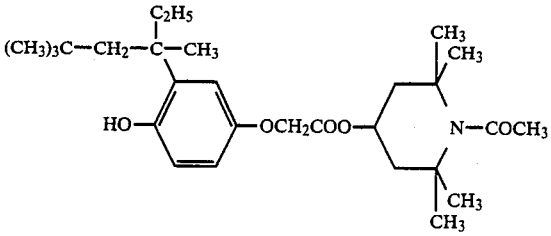

-continued
IV-30
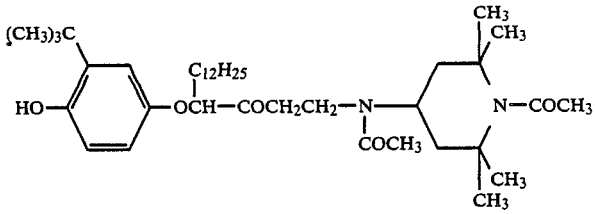
IV-31
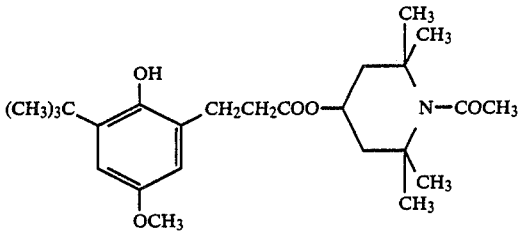
IV-32
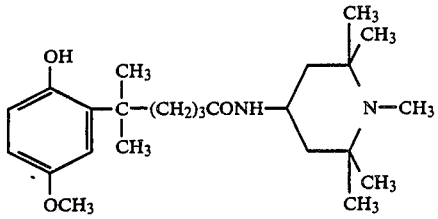
IV-33
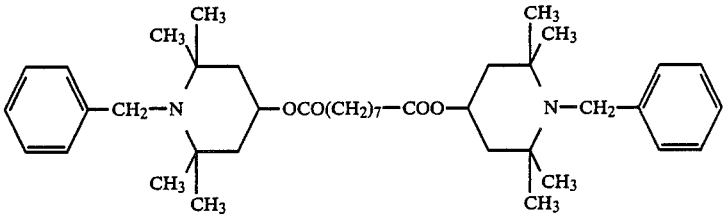
IV-34
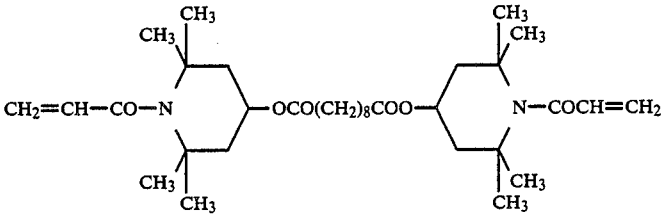
IV-35
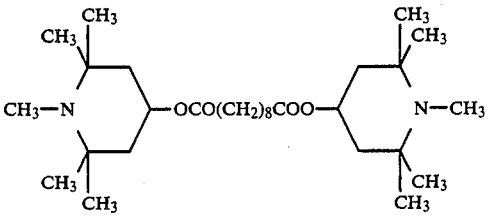
IV-36
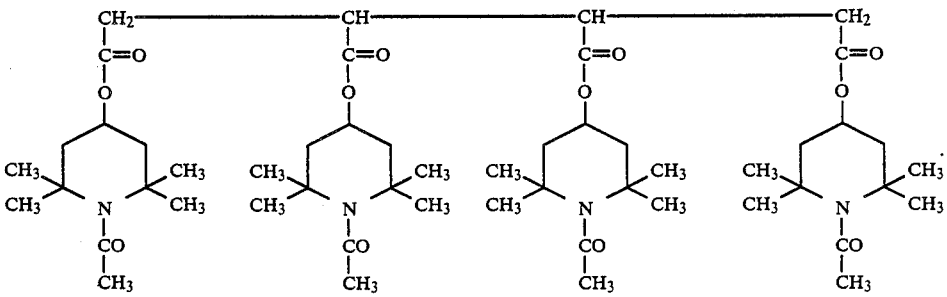

-continued

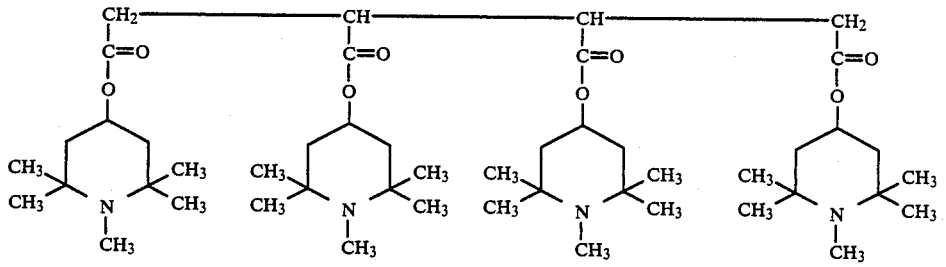

IV-37

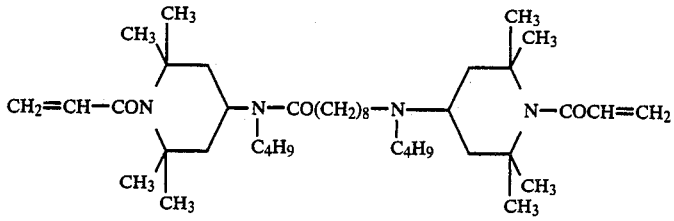

IV-38

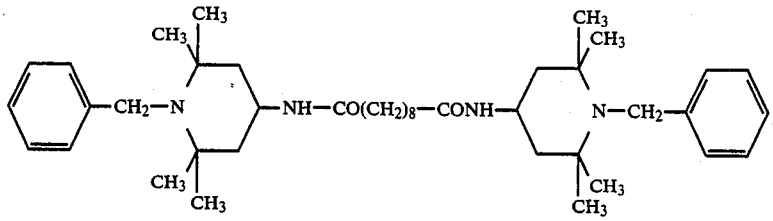

IV-39

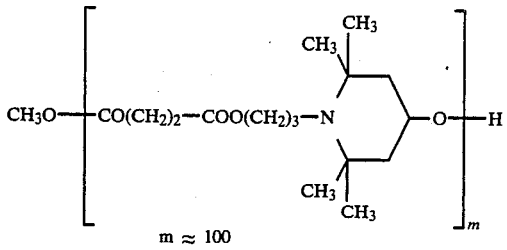

IV-40

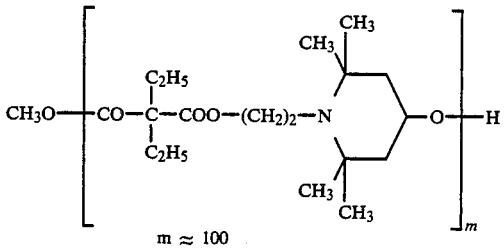

IV-41

In the light-sensitive materials of the invention, the sterically hindered compounds or the polyalkylpiperidine type compounds may be added in an amount of from 5 to 100% by weight and, more preferably, from 10 to 50% by weight to the yellow couplers used therein.

In the light-sensitive materials of the invention, it is prepferred that the silver halide emulsion layers each containing both of the compounds represented by General Formula [I] and the yellow couplers represented by General Formula [II] further contain the diffusion-proof hydroquinone compounds each represented by the following General Formula [IV]:

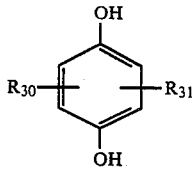

General Formula [V]

Wherein $R_{30}$ and $R_{31}$ represent an alkyl group which is allowed to have a hydrogen atom or a substituent having 1 to 20 carbon atoms and, a total carbon atom number of the $R_{30}$ and $R_{31}$ is to be not less than 8.

The typical examples of the above-mentioned compounds include those described in U.S. Pat. Nos. 200,337, 2,360,296, 2,728,659 and, 3,700,453; Japanese Patent Examined Publication No. 23813/1975; Japanese Patent O.P.I. Publication Nos. 97021/1979 and 24141/1983; Japanese Patent Examined Publication No. 47702/1983 and Japanese Patent O.P.I. Publication No. 29637/79.
Next, the typical examples of the compounds will be given below:
HQ-1
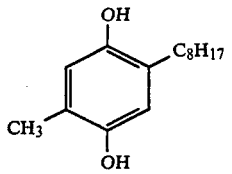
HQ-2
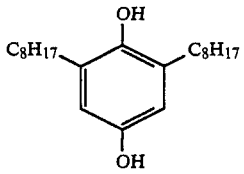
HQ-3
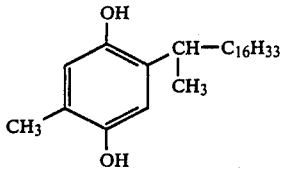
HQ-4
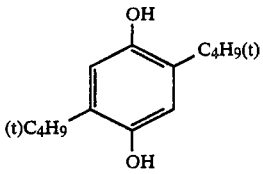
HQ-5
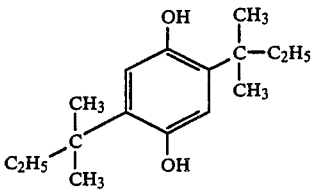
HQ-6
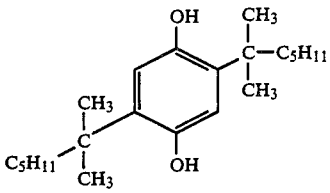
HQ-7
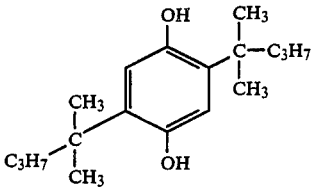
HQ-8
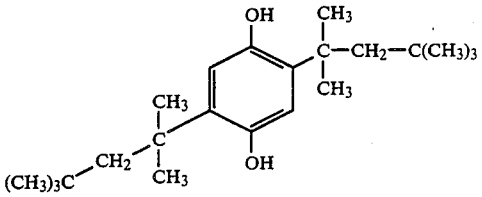
HQ-9
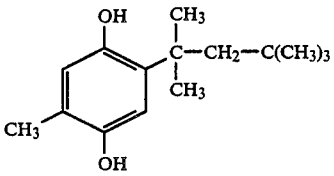
HQ-10
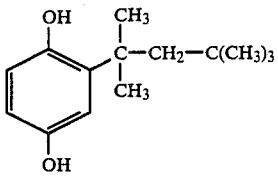
HQ-11
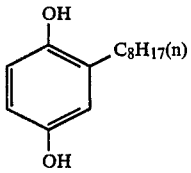
HQ-12
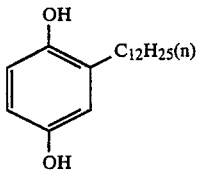
HQ-13
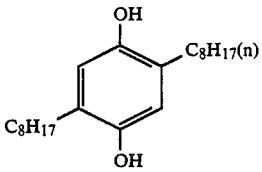
HQ-14
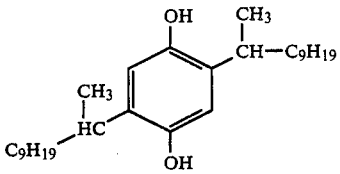
HQ-15
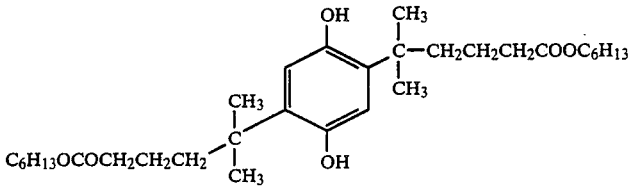

-continued

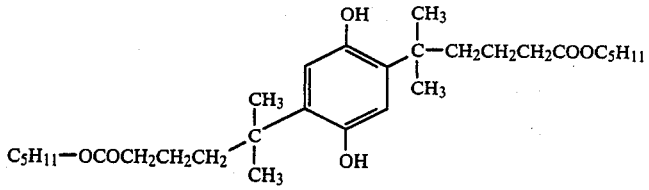

HQ-16

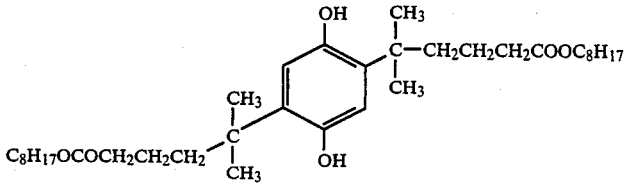

HQ-17

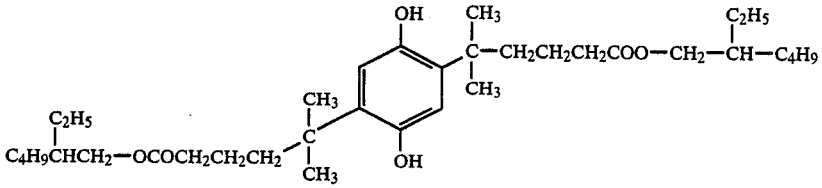

HQ-18

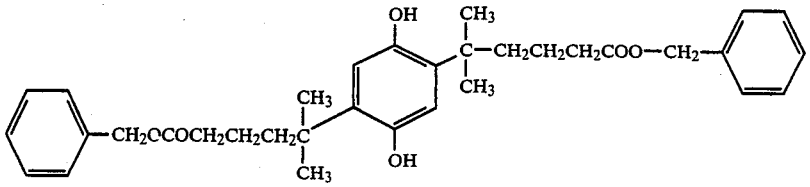

HQ-19

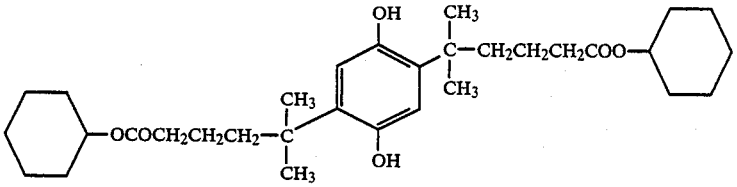

HQ-20

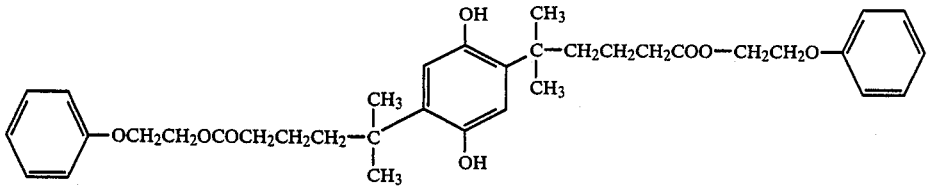

HQ-21

Now, how to add the diffusion-proof yellow couplers, the compounds represented by the aforegiven General Formula [I], HP and PAP into a silver halide emulsion layer will be described in detail, below.

In the silver halide photographic light-sensitive materials of the invention, it is preferred that the above-mentioned diffusion-proof yellow couplers, compounds each represented by the aforegiven General Formula [I] and at least one kind of the compound selected from the group consisting of HPs and PAPs are to be emulsified and dispersed independently or in combination with two or more kinds thereof arbitrarily at the same time, respectively, in a hydrophilic colloidal layer.

As for dispersing these substances into a hydrophilic colloid, they are normally dissolved in a high boiling organic solvent before they are dispersed in the colloid. In the meantime, the compounds represented by General Formula [I] have a property in themselves to serve as a high boiling solvent.

Accordingly, the compounds represented by the aforegiven General Formula [I] are allowed to serve by themselves as a high boiling organic solvent for the above-mentioned diffusion-proof couplers, HP or PAP or the above-mentioned yellow couplers, the compounds represented by the General Formula [I], HP or PAP may also be emulsified and dispersed by making use of the other well-known high boiling organic solvents.

Such high boiling organic solvents are those not miscible with water but having a boiling point of about 170° C. or higher.

They include, for example, phthalic acid esters (such as dimethyl phthalate, dibutyl phthalate, dioctyl phthalate, diallyl phthalate, dinonyl phthalate, dilauryl phthalate, dibenzyl phthalate, diphenyl phthalate and so forth); phosphoric acid esters (such as diphenyl phosphate, tricresyl phosphate, triphenyl phosphate, dioctylbutyl phosphate, trihexyl phosphate, trioctyl phosphate and so forth); citric acid esters (such as tributyl acetylcitrate, tributyl citrate and so forth); benzoic acid esters (such as butyl benzoate, octyl benzoate and so forth); alkylamides (such as diethyl laurylamide and so forth); sebacic acid esters (such as diethylhexyl sebacate and so forth); stearic acid esters (such as butyl stearate and so forth); maleic acid esters (such as dinonyl maleate and so forth); succinic acid esters (such as diethyl succinate and so forth); adipic acid esters (such as dioctyl adipate and so forth); pyrolidones (such as N-dodecyl pyrolidone and so forth); and the like.

When emulsifying and dispersing the above-mentioned compounds in a hydrophilic colloid, the compounds are dissolved with a well-kown high boiling organic solvent, if required, (and with such a water-miscible low boiling organic solvent as ethyl acetate, butyl alcohol, methylisobutyl ketone, hexane, acetone, dioxane and so forth, if further required), and the resulting solution is mixed up with such a hydrophilic colloidal solution as a gelatin solution containing a surface active agent, and the emulsification and dispersion are then carried out in a well-known method.

The above-mentioned diffusion-proof yellow couplers are to be added in an amount within the range of from 0.002 mol to 1 mol and, more preferably, from 0.05 to 0.8 mol per mol of a silver halide used into a silver halide emulsion layer, and the couplers may also be used upon mixing two or more kinds thereof.

The compounds represented by the aforegiven General Formula [I] are to be used in a proportion within the range of from 5 to 200% by weight and, more preerably, from 10 to 100% by weight to an amount of the above-mentioned diffusion-proof couplers used.

When a silver halide emulsion layer containing a compound represented by the General Formula [I] further contains a high boiling organic solvent in addition to the compound represented by the General Formula [I], the proportion of the compound represented by the General Formula [I] is to be within the range of from 20 to 100% by weight to a total amount of the high boiling organic solvent (including the compound represented by the General Formula [I]) present in the silver halide emulsion layer.

There also uses at least one kind of the compound selected from the group consisting of HPs and PAPs in a proportion within the range of from 5to 100% by weight and, more preferably, from 10 to 70% by weight to an amount of the above-mentioned diffusion-proof couplers used. In this case, it is also allowed to use two or more kinds of HPs and PAPs in combination, respectively and, further, to use HPs and PAPs in combination in one and the same silver halide emulsion layer.

Silver halide photographic light-sensitive materials of the invention have the advantages that, the effects of color stabilization against light upon dye images can be kept increased for a substantially longer time by making use of the compounds represented by the General Formula [I] and the above-mentioned HPs and/or PAPs in combination and the effects of inhibiting both maximum density and gradation from lowering can also be displayed.

This invention may be applied to multilayered color light-sensitive materials and any of the well-known layer arrangement may be applied thereto. There may be able to use such an ordinary layer arrangement as is comprised of a support bearing thereon a cyan coupler containing red-sensitive emulsion layer, a magenta coupler containing green-sensitive emulsion layer and a yellow coupler containing blue-sensitive emulsion layer (of which the layer arrangement order may suitably be selected in accordance with the purposes and each of the color-sensitive layers may also be comprised of two or more layers) and, in addition, a filter layer, an interlayer, a protective layer, a subbing layer and so forth. It is also allowed to match the color sensitivity of an emulsion layer with a dye forming coupler in the other ways than the above.

To the silver halide emulsions to be used in the light-sensitive materials of the invention, any of the silver halides capable of being used in ordinary silver halide emulsions, such as silver bromide, silver iodobromide, silver iodochloride, silver chlorobromide, silver chloride and so forth.

The silver halide emulsions each containing the silver halides relating to the invention may be treated in chemical sensitizations including, for example, a noble-metal sensitization with the salts of noble metals such as ruthenium, rhodium, palladium, iridium, platinum, gold and so forth (including, more particularly, ammonium chloropalladate, potassium chloroplatinate, potassium chloropalladite, potassium chloroaurate and so forth); a sulfur sensitization with an active gelatin or labile sulfur compounds (such as sodium thiosulfate and so forth); a selenium sensitization with a selenium compound; or a reduction sensitization, under a relatively low pAg condition, with a stannous salt, a polyamine and so forth.

In addition to the above, The above-mentioned silver halide emulsions may be chemically sensitized by making use of various kinds of sensitizers with the purpose of endowing a desired spectral wave length region with a spectral photosensitivity. The spectral sensitizers preferably useful therein include, for example, such a cyanine dye, merocyanine dye or complex cyanine dye as described in U.S. Pat. Nos. 1,939,201, 2,072,908, 2,739,149, 2,213,995, 2,493,748 and 2,519,001; West German Patent No. 929,080; and British Pat. No. 505,979; and they may be used independently or in combination. Such a variety of optical sensitizers as given above may also be used with the other purposes than their own intrinsic purposes, such as the purposes of preventing fogs, preventing photographic characteristics from deteriorating in storing silver halide color photographic light-sensitive materials or controlling a development such as a gradation control and so forth.

Besides the above, the layers each forming a silver halide photographic light-sensitive material relating to the invention are allowed to contain, if necessary, chemical sensitizers such as a thioether compound, a quaternery ammonium salt compound, a polyalkylene oxide compound and so forth, or stabilizers such as a triazole, an imidazole, an azaindene, a benzothiazolium compound, a zinc compound, a cadmium compound a mercapto compound and so forth, provided that these additives may not reduce any effect of the invention.

Any layers each forming a silver halide photographic light-sensitive material relating to the invention allowed to contain a variety of photographic additives including, for example, UV absorbers such as a benzophenone type compound and a benzotriazole type compound; development accelerators such as an 1-aryl-3-pyrazolidone type compound; surfactants such as sodium alkylnaphthalene sulfonate, sodium alkylbenzenesulfonate, sodium alkylsuccinate sulfonate, fluorinated sodium alkylsuccinate sulfonate, a polyalkylene compound and so forth; water-soluble irradiation-prevention dyes such as an azo type compound, a styryl type compound, an oxonol type compound, a triphenylmethane type compound and so forth; black-and-white developers such as a hydroquinone, a catechol, an 1-aryl-3-pyrazolidone and so forth; hardeners such as a halogen-substituted s-triazine type compound, an active vinyl type compound, an ethyleneimino type compound, an epoxy type compound, a water-soluble aluminium salt and so forth; agents of improving the physical properties of layers such as glycerol, a polyalkylene gllycol, a polymeric aqueous dispersed matter, i.e., a latex, a solid or liquid paraffin and so forth; optical brightening agents such as a diaminostilbene type compound and so forth); and the like additives.

EXAMPLES

Some concrete examples of this invention will now be described below and it is, however, to be understood that the embodiments of this invention shall not be limited thereto.

Example-1

Each of supports made of a sheet of paper having a weight of 170 g/m$^2$ was coated over to one side thereof with polyethylene and to the other side thereof with another polyethylene containing an anatase type titanium dioxide in a proportion of 11% by weight. Each of the resulted polyethylene-coated supports was coated over to the titanium dioxide containing polyethylene side of the support with the following layers in order, so as to prepare the silver halide color photographic light-sensitive materials 1 through 30. Each of the amounts added is indicated in an amount per sq. meter of the respective light-sensitive materials, unless otherwise specifically stated.

Layer 1

A layer containing 1.9 g of gelatin, 0.39 g (in terms of silver by weight—the same term applies correspondingly to the following examples) of a blue-sensitive silver chlorobromide emulsion and the high boiling organic solvents hereinafter abbreviated to HBS, corresponding to the respective samples as indicated in Table-1. In the high boiling organic solvents, $1.2\times10^{-3}$ mol of the following yellow coupler Y-32, 0.03 g of the anticolorstaining agent HQ-8 and the exemplified HP or PAP (of which the amounts added are indicated in Table-1) were dissolved. In this layer, the compounds represented by General Formula [I] were used in substitution with such a well-known high boiling organic solvent as DOP.

Layer 2

A layer containing 1.4 g of gelatin and 0.4 g of di-(2-ethylhexyl)phthalate (hereinafter called DOP) in which 0.6 g of the following UV absorber UV-1 were dissolved.

Layer 3

A layer containing 1.0 g of gelatin and 0.045 g of sodium 2,4-dichloro-6-hydroxy-S-triazine (i.e., a hardener).

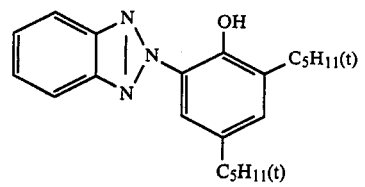

UV-1

The above-mentioned light-sensitive materials 1 through 30 were exposed to light through an optical wedge and were then processed in the following steps, respectively.

| | Processing step | |
|---|---|---|
| | I<br>Color developer A | II<br>Color developer B |
| Color development | 38° C., 3 min. | 35° C., 50 sec. |
| Bleach-fixation | 33° C., 1 min. 30 sec. | 33° C., 50 sec. |
| Washing | 30~34° C., 2 min. | 30~34° C., 1 min. 30 sec. |
| Drying | 60~80° C., 1 min. | 60~80° C., 1 min. |

The composition of the processing liquids are as follows:

| Composition of Color Developer | A | B |
|---|---|---|
| Pure water | 800 ml | 800 ml |
| Ethylene glycol | 15 ml | — |
| Benzyl alcohol | 15 ml | — |
| Hydroxylamine sulfate | 2.5 g | 2.5 g |
| Potassium bromide | 1.2 g | 0.6 g |
| Sodium chloride | 0.3 g | 0.3 g |
| Potassium sulfite | 2.0 g | 2.0 g |
| Color developing agent(*1) | 4.5 g | 12.0 g |
| 1-hydroxyethylidene-1,1-diphosphate | 1.0 g | 1.0 g |
| Potassium carbonate | 25.0 g | 30.0 g |
| Whitex BB conc. (Optical brightening agent) (Made by Sunitomo Chemical Co.) | 1.0 g | 1.0 g |
| pH(*2) | 10.1 | 11.2 |

(*1)Color developing agent: N—ethyl-N—β-methanesulfonamidoethyl-3-methyl-4-amino-aniline sulfate (*2)Pure water was added to each of the color developers so as to make one liter in total and the pH values thereof were adjusted with a 20% aqueous solution of either dillute sulfuric acid or potassium hydroxide to the above-given pH values.

| Composition of Bleach-fixer | |
|---|---|
| Pure water | 600 ml |
| Ammonium iron (III) ethylenediamine-tetraacetate | 65 g |
| Sodium 2-ethylenediaminetetraacetate | 5 g |
| Ammonium thiosulfate | 85 g |
| Sodium hydrogensulfite | 10 g |
| Sodium metabisulfite | 2 g |
| Sodium bromide | 10 g |
| Hydroxylamine sulfate | 2 g |
| Color developer A | 200 ml |
| Pure water to be added to make pH value to be adjusted with dillute sulfuric acid to 7.0 | 1 liter |

With respect to each of the samples obtained, the reflection densities thereof were measured by making use of monochratic blue-light so as to obtain the respective characteristic curves. From the curves, the maximum densities and contrasts thereof (i.e., the inclination of the reflection densities of from 0.5 to 1.5) were obtained. The results therefrom are shown in Table-1.

TABLE 1

| Sample No. | HP or PAP | | High boiling organic solvent | | Maximum density I | Maximum density II | Contrast I | Contrast II | Color fastness against light I | Color fastness against light II |
|---|---|---|---|---|---|---|---|---|---|---|
| 1 | — | | DOP | 0.50 | 2.63 | 2.48 | 2.96 | 2.61 | 42 | 36 |
| 2 | — | | TCP | 0.50 | 2.60 | 2.49 | 2.92 | 2.57 | 35 | 29 |
| 3 | — | | TOP | 0.50 | 2.65 | 2.55 | 3.13 | 2.53 | 32 | 27 |
| 4 | — | | [I-4] | 0.50 | 2.65 | 2.50 | 3.07 | 2.55 | 40 | 29 |
| 5 | — | | [I-24] | 0.50 | 2.63 | 2.50 | 3.09 | 2.59 | 41 | 25 |
| 6 | — | | [I-29] | 0.50 | 2.65 | 2.53 | 2.97 | 2.61 | 38 | 27 |
| 7 | [III-33] | 0.45 | DOP | 0.50 | 2.50 | 2.11 | 2.74 | 1.97 | 62 | 50 |
| 8 | [III-33] | 0.45 | TCP | 0.50 | 2.53 | 2.13 | 2.66 | 1.86 | 57 | 49 |
| 9 | [III-33] | 0.45 | TOP | 0.50 | 2.54 | 2.13 | 2.70 | 1.90 | 55 | 43 |
| 10 | [III-33] | 0.45 | [I-4] | 0.50 | 2.53 | 2.16 | 2.71 | 1.85 | 76 | 76 |
| 11 | [III-33] | 0.45 | [I-24] | 0.50 | 2.52 | 2.15 | 2.68 | 1.90 | 79 | 77 |
| 12 | [III-33] | 0.45 | [I-29] | 0.50 | 2.55 | 2.17 | 2.65 | 1.95 | 77 | 76 |
| 13 | [III-38] | 0.45 | DOP | 0.50 | 2.49 | 2.05 | 2.63 | 1.62 | 65 | 53 |
| 14 | [III-38] | 0.45 | TCP | 0.50 | 2.47 | 2.02 | 2.71 | 1.60 | 55 | 47 |
| 15 | [III-38] | 0.45 | TOP | 0.50 | 2.45 | 2.13 | 2.62 | 1.70 | 60 | 49 |
| 16 | [III-38] | 0.45 | [I-4] | 0.50 | 2.50 | 2.07 | 2.74 | 1.68 | 80 | 78 |
| 17 | [III-38] | 0.45 | [I-24] | 0.50 | 2.48 | 2.06 | 2.70 | 1.65 | 81 | 80 |
| 18 | [III-38] | 0.45 | [I-29] | 0.50 | 2.47 | 2.08 | 2.71 | 1.73 | 81 | 80 |
| 19 | [IV-19] | 0.45 | DOP | 0.50 | 2.39 | 1.97 | 2.55 | 1.33 | 62 | 47 |
| 20 | [IV-19] | 0.45 | TCP | 0.50 | 2.41 | 1.92 | 2.50 | 1.46 | 60 | 49 |
| 21 | [IV-19] | 0.45 | TOP | 0.50 | 2.42 | 1.99 | 2.60 | 1.41 | 61 | 49 |
| 22 | [IV-19] | 0.45 | [I-4] | 0.50 | 2.42 | 2.03 | 2.61 | 1.67 | 78 | 76 |
| 23 | [IV-19] | 0.45 | [I-24] | 0.50 | 2.41 | 2.00 | 2.60 | 1.41 | 76 | 76 |
| 24 | [IV-19] | 0.45 | [I-29] | 0.50 | 2.40 | 1.97 | 2.63 | 1.53 | 77 | 75 |
| 25 | [IV-40] | 0.45 | DOP | 0.50 | 2.48 | 2.12 | 2.74 | 1.63 | 60 | 44 |
| 26 | [IV-40] | 0.45 | TCP | 0.50 | 2.47 | 2.06 | 2.70 | 1.55 | 59 | 49 |
| 27 | [IV-40] | 0.45 | TOP | 0.50 | 2.50 | 2.10 | 2.69 | 1.50 | 59 | 47 |
| 28 | [IV-40] | 0.45 | [I-4] | 0.50 | 2.49 | 2.07 | 2.71 | 1.60 | 82 | 82 |
| 29 | [IV-40] | 0.45 | [I-24] | 0.50 | 2.45 | 2.09 | 2.72 | 1.57 | 81 | 80 |
| 30 | [IV-40] | 0.45 | [I-29] | 0.50 | 2.46 | 2.13 | 2.68 | 1.54 | 82 | 82 |

DOP: Di-(2-ethylhexyl)phthalate
TCP: Tricresyl phosphate
TOP: Tri-(2-ethylhexyl)phosphate
In the columns of the above-mentioned color stabilzer against light and high boiling organic solvent, the values indicated therein mean the respective amounts added per sq. meter of light-sensitive materials used.

Further, with the samples obtained, the color fastness against light of the dye images formed on the samples were checked up in the following method. The results thereof are also shown in Table-1.

(Color fastness against light)

The samples were irradiated by light for 400 hours by making use of a xenon fade-o-meter (manufactured by Suga Test Equipment Co.) so as to obtain the respective dye-image remaining ratios (%).

From the results shown in Table-1, it was found that the Samples containing Exemplified Compound [I-4], [I-24] or [I-29] had the maximum densities and contrasts respectively equivalent to Comparative HBSs (such as DOP, TCP, TOP and so on) even in each case that Processes I and II were carried out.

In the case of not using any color-stabilizer against light, it was found that almost no improvement effect upon color fastness against light was displayed when Exemplified Compound (I-4, I-24 or I-29) was served as an HBS and, in the case of using an HP or a PAP, it was found that color stability against light was more increased by making use of the compounds each represented by the aforegiven General Formula [I]. Further, from the comparison of Process II with Process I, it was found that, in Process II using a color developer not containing any benzyl alcohol, the samples not containing any of color-stabilizers against light and compounds of the invention represented by the General Formula [I] were deteriorated in color fastness against light as compared with the case of Process I and, on the contrary, the samples of the invention containing both of the above-mentioned elements were not almost deteriorated therein.

Example-2

With respect to each of the samples developed in Example-1, the color fastness against light thereof was checked up by a xenon fade-o-meter in the samw manner as mentioned in Example-1, except that the irradiation time was varied for 120 hours, 240 hours and 360 hours, respectively. The results thereof are shown in Table-2 below.

TABLE-2

| Sample No. | Color fastness against light [I] 120 hours | [I] 240 hours | [I] 360 hours | [II] 120 hours | [II] 240 hours | [II] 360 hours |
|---|---|---|---|---|---|---|
| 1 | 80 | 62 | 48 | 77 | 64 | 42 |
| 2 | 77 | 61 | 40 | 74 | 62 | 34 |
| 3 | 76 | 58 | 39 | 73 | 60 | 33 |
| 4 | 92 | 69 | 45 | 90 | 70 | 35 |
| 5 | 94 | 71 | 45 | 91 | 69 | 29 |
| 6 | 91 | 67 | 44 | 90 | 65 | 32 |
| 7 | 90 | 79 | 69 | 89 | 73 | 57 |
| 8 | 89 | 77 | 64 | 89 | 75 | 56 |
| 9 | 90 | 77 | 63 | 88 | 75 | 51 |
| 10 | 94 | 90 | 84 | 93 | 89 | 83 |
| 11 | 96 | 91 | 88. | 93 | 90 | 86 |
| 12 | 95 | 90 | 87 | 94 | 90 | 87 |
| 13 | 91 | 83 | 72 | 87 | 72 | 61 |
| 14 | 89 | 79 | 61 | 85 | 72 | 54 |
| 15 | 89 | 79 | 65 | 84 | 73 | 55 |
| 16 | 93 | 90 | 87 | 93 | 91 | 87 |
| 17 | 94 | 91 | 86 | 94 | 90 | 85 |
| 18 | 94 | 90 | 84 | 94 | 90 | 86 |
| 19 | 90 | 79 | 65 | 89 | 77 | 54 |
| 20 | 91 | 80 | 65 | 90 | 79 | 55 |

TABLE-2-continued

| Sample No. | Color fastness against light [I] 120 hours | [I] 240 hours | [I] 360 hours | [II] 120 hours | [II] 240 hours | [II] 360 hours |
|---|---|---|---|---|---|---|
| 21 | 91 | 80 | 67 | 90 | 75 | 55 |
| 22 | 94 | 90 | 85 | 92 | 89 | 84 |
| 23 | 94 | 89 | 83 | 93 | 90 | 84 |
| 24 | 95 | 90 | 83 | 94 | 91 | 86 |
| 25 | 89 | 81 | 65 | 83 | 69 | 51 |
| 26 | 92 | 80 | 63 | 84 | 71 | 54 |
| 27 | 91 | 82 | 64 | 87 | 72 | 53 |
| 28 | 96 | 93 | 89 | 94 | 92 | 89 |
| 29 | 96 | 92 | 89 | 96 | 93 | 90 |
| 30 | 96 | 92 | 88 | 95 | 92 | 89 |

From the results shown in Table-2, it is understood that the samples 4, 5 and 6 each containing the compounds represented by General Formula [I] but not containing any of HPs and PAPs displayed a color fading prevention effect especially in the initial stage of color fading when they were processed in both Processes [I] and [II] and, that the samples 10, 11, 12, 16, 17, 18, 22, 23, 24, 28, 29, 30 each containing HPs or PAPs and the compounds represented by General Formula [I] in combination displayed a substantially low color fading against light all through the stages from the initial stage of irradiation of light to the color fading stage being under way.

Example-3

Samples 31 through 50 were prepared in the same manner as in Example-1, except that the yellow couplers used herein were changed into those shown in Table-3 below and the compounds shown in Table-3 were added to serve as the high boiling organic solvents.

With respect to each of the resulted samples, the color fastness against light of the obtained dye image was evaluated in the same manner as in Example-1. (Irradiation time: 120, 240 and 360 hours) The processing were made in Process [II].

The results thereof are shown in Table-3 below:

TABLE-3

| Sample No. | Yellow coupler | High boiling organic solvent | Color fastness against light 120 hours | 240 hours | 360 hours |
|---|---|---|---|---|---|
| 31 | Comparative coupler-1 | DOP | 47 | 30 | 7 |
| 32 | Comparative coupler-1 | TCP | 44 | 26 | 6 |
| 33 | Comparative coupler-1 | [I-4] | 49 | 29 | 7 |
| 34 | Comparative coupler-1 | [I-10] | 48 | 30 | 6 |
| 35 | Comparative coupler-2 | DOP | 50 | 35 | 12 |
| 36 | Comparative coupler-2 | TCP | 48 | 31 | 10 |
| 37 | Comparative coupler-2 | [I-4] | 47 | 29 | 11 |
| 38 | Comparative coupler-2 | [I-10] | 50 | 33 | 13 |
| 39 | Comparative coupler-3 | DOP | 51 | 35 | 13 |
| 40 | Comparative coupler-3 | TCP | 48 | 30 | 10 |
| 41 | Comparative coupler-3 | [I-4] | 53 | 36 | 11 |
| 42 | Comparative coupler-3 | [I-10] | 51 | 30 | 11 |
| 43 | Y-(A)-26 | DOP | 63 | 51 | 30 |
| 44 | Y-(A)-26 | TCP | 60 | 47 | 28 |
| 45 | Y-(A)-26 | [I-4] | 88 | 62 | 33 |
| 42 | Y-(A)-26 | [I-10] | 87 | 61 | 32 |
| 47 | Y-(B)-25 | DOP | 71 | 53 | 22 |
| 48 | Y-(B)-25 | TCP | 69 | 50 | 20 |
| 49 | Y-(B)-25 | [I-4] | 90 | 59 | 22 |
| 50 | Y-(B)-25 | [I-10] | 89 | 61 | 23 |

Comparative coupler-1

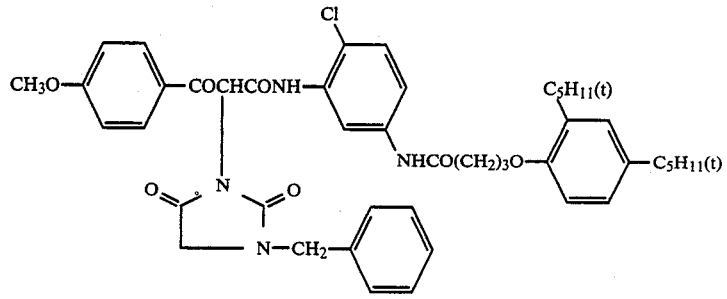

Comparative coupler-2

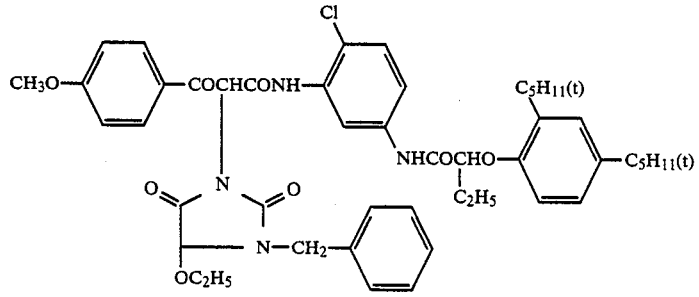

TABLE-3-continued

Comparative coupler-3

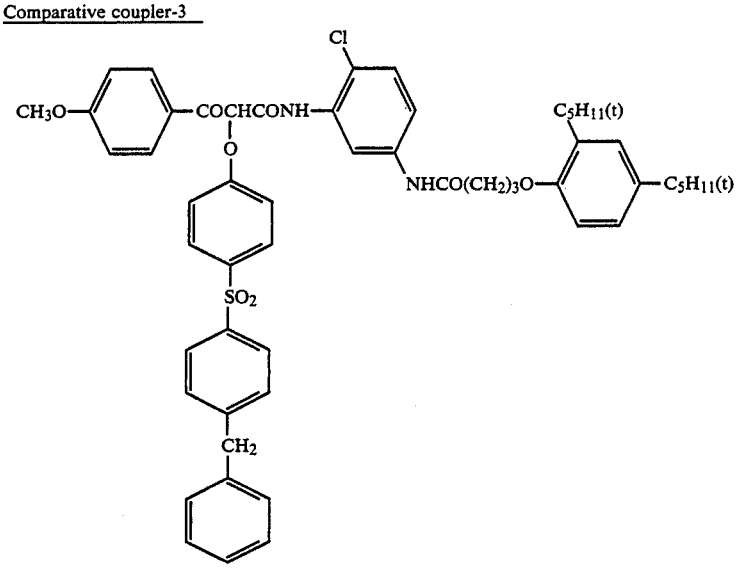

From the results shown in Table-3, it was understood that the color fastness against light was not effectively improved with the use of the yellow couplers other than those of the invention even when the compounds represented by General Formula [I] were added thereto and, on the other hand, the color fastness against light was effectively improved with the use of the yellow couplers of the invention.

Example-4

Light-sensitive materials 51 through 68 were prepared as same as in Example-1, except that DOP and [I-4] were used to serve as the high boiling organic solvents and [III-37] was used to serve as HP and, further, the amounts added of the [III-37] were changed as shown in the following Table-4.

The samples prepared were processed in the same manner as in Example-1 and the results obtained thereby are also shown in Table-4. (Every color fastness against light was evaluated for 100, 200 and 400 hours with a zenon fade-o-meter, respectively)

From the results shown in Table-4, it was found that, when DOP was used as comparative HBS, every color fastness against light was gradually improved as an amount of III-37 was being increased and, accordingly, the respective maximum densities and contrasts were more lowered (particularly in Process II). On the other hand, in Samples 63 through 68 containing I-4 of the invention, it was also found that every color fastness was further improved on saturated level as an amount of III-37 was being increased, comparing with the case of using DOP.

It was further found that, in using I-4, the respective color image stability were higher than in using DOPs and HBSs, even when III-37 was so added as not to much lower the maximum desities and contrasts.

TABLE 4

| Sample No. | HP (III-37) | High boiling organic solvent | Maximum density I | Maximum density II | Contrast I | Contrast II | Color fastness against light [I] 100 | [I] 200 | [I] 400 | [II] 100 | [II] 200 | [II] 400 |
|---|---|---|---|---|---|---|---|---|---|---|---|---|
| 51 | 0 | DOP (0.4 g) | 2.65 | 2.45 | 3.03 | 2.70 | 89 | 76 | 40 | 87 | 72 | 35 |
| 52 | 0.1 g | DOP (0.4 g) | 2.65 | 2.42 | 3.00 | 2.69 | 90 | 77 | 41 | 89 | 75 | 36 |
| 53 | 0.2 g | DOP (0.4 g) | 2.67 | 2.41 | 2.87 | 2.61 | 90 | 79 | 49 | 90 | 76 | 39 |
| 54 | 0.3 g | DOP (0.4 g) | 2.58 | 2.29 | 2.79 | 2.46 | 91 | 80 | 56 | 91 | 77 | 44 |
| 55 | 0.4 g | DOP (0.4 g) | 2.47 | 2.10 | 2.69 | 1.62 | 92 | 80 | 60 | 91 | 78 | 49 |
| 56 | 0.6 g | DOP (0.4 g) | 2.30 | 1.82 | 2.40 | 1.03 | 93 | 83 | 61 | 92 | 80 | 52 |
| 57 | 0 | DOP (0.2 g) + [I-4] (0.2 g) | 2.65 | 2.46 | 3.07 | 2.79 | 92 | 79 | 41 | 90 | 73 | 34 |
| 58 | 0.1 g | DOP (0.2 g) + [I-4] (0.2 g) | 2.63 | 2.40 | 3.01 | 2.72 | 93 | 83 | 54 | 92 | 79 | 49 |
| 59 | 0.2 g | DOP (0.2 g) + [I-4] (0.2 g) | 2.65 | 2.37 | 2.94 | 2.65 | 94 | 85 | 67 | 93 | 83 | 63 |
| 60 | 0.3 g | DOP (0.2 g) + [I-4] (0.2 g) | 2.57 | 2.26 | 2.87 | 2.41 | 95 | 85 | 74 | 93 | 84 | 72 |
| 61 | 0.4 g | DOP (0.2 g) + [I-4] (0.2 g) | 2.51 | 2.07 | 2.71 | 1.58 | 95 | 86 | 75 | 94 | 84 | 71 |
| 62 | 0.6 g | DOP (0.2 g) + [I-4] (0.2 g) | 2.34 | 1.79 | 2.46 | 0.97 | 95 | 87 | 75 | 95 | 86 | 73 |
| 63 | 0 | [I-4] (0.4 g) | 2.68 | 2.41 | 3.07 | 2.60 | 93 | 77 | 41 | 93 | 76 | 29 |
| 64 | 0.1 g | [I-4] (0.4 g) | 2.65 | 2.43 | 2.96 | 2.58 | 96 | 89 | 59 | 95 | 87 | 58 |
| 65 | 0.2 g | [I-4] (0.4 g) | 2.66 | 2.40 | 2.95 | 2.53 | 96 | 91 | 77 | 95 | 88 | 76 |
| 66 | 0.3 g | [I-4] (0.4 g) | 2.57 | 2.28 | 2.92 | 2.40 | 96 | 91 | 80 | 96 | 89 | 78 |
| 67 | 0.4 g | [I-4] (0.4 g) | 2.46 | 2.11 | 2.81 | 1.72 | 97 | 92 | 80 | 96 | 89 | 78 |
| 68 | 0.6 g | [I-4] (0.4 g) | 2.32 | 1.81 | 2.60 | 1.03 | 97 | 92 | 81 | 96 | 90 | 79 |

Example-5

The same samples as in Example-4 were prepared repeatedly, provided however that, in each of the samples, Exemplified compound (Y-41) was used and [IV-19] was also used as PAP, respectively, in such amounts changed as shown in Table-5 and, further, TOP (for the comparison purpose) and Exemplified Compound,

[I-24], were used as the high boiling organic solvents, respectively.

The results thereof are shown in Table-5 below:

TABLE 5

| Sample No. | PAP (IV-19) | High boiling organic solvent | Maximum density I | Maximum density II | Contrast I | Contrast II | Color fastness against light [I] 100 | [I] 200 | [I] 400 | [II] 100 | [II] 200 | [II] 400 |
|---|---|---|---|---|---|---|---|---|---|---|---|---|
| 69 | 0 | TOP 0.5 g | 2.70 | 2.65 | 3.41 | 3.27 | 86 | 57 | 16 | 85 | 53 | 14 |
| 70 | 0.1 g | TOP 0.5 g | 2.71 | 2.64 | 3.35 | 3.20 | 88 | 73 | 24 | 87 | 61 | 24 |
| 71 | 0.2 g | TOP 0.5 g | 2.68 | 2.65 | 3.36 | 3.19 | 88 | 75 | 36 | 88 | 68 | 34 |
| 72 | 0.3 g | TOP 0.5 g | 2.68 | 2.60 | 3.29 | 3.10 | 89 | 76 | 41 | 88 | 70 | 37 |
| 73 | 0.4 g | TOP 0.5 g | 2.60 | 2.51 | 3.11 | 2.95 | 89 | 77 | 45 | 89 | 72 | 41 |
| 74 | 0.6 g | TOP 0.5 g | 2.60 | 2.38 | 2.96 | 2.42 | 90 | 79 | 46 | 89 | 75 | 42 |
| 75 | 0 | [I-24] 0.5 g | 2.72 | 2.72 | 3.54 | 3.48 | 91 | 66 | 17 | 90 | 63 | 16 |
| 76 | 0.1 g | [I-24] 0.5 g | 2.72 | 2.70 | 3.49 | 3.52 | 94 | 77 | 36 | 94 | 78 | 34 |
| 77 | 0.2 g | [I-24] 0.5 g | 2.70 | 2.65 | 3.52 | 3.47 | 94 | 83 | 59 | 95 | 84 | 58 |
| 78 | 0.3 g | [I-24] 0.5 g | 2.70 | 2.60 | 3.50 | 3.36 | 95 | 85 | 62 | 95 | 86 | 61 |
| 79 | 0.4 g | [I-24] 0.5 g | 2.61 | 2.52 | 3.44 | 3.21 | 95 | 88 | 61 | 95 | 87 | 61 |
| 80 | 0.6 g | [I-24] 0.5 g | 2.60 | 2.41 | 3.27 | 3.06 | 95 | 87 | 63 | 96 | 88 | 62 |

From the results thereof shown in Table-5, it can be understood that, also in this invention, a substantially more excellent color fastness against light can be displayed with the use of PAP in a relatively less amount when using the compounds represented by General Formula [I].

Example-6

Each of the multilayered color printing paper samples 81 through 95 was prepared in such a manner that a corona-discharge was applied over to the same polyethylene-laminated paper support as those used in Example-1 and the following layers were each coated simultaneously to the support.

Layer 1

A layer containing 1.3 g of gelatin, 0.28 g of a blue-sensitive and cubic system silver chlorobromide emulsion (in terms of silver bromide contents at 70 mol% and average grain size of 0.46 μm) and 0.6 g of HBSs, (each shown in Table-6), into which $1.25\times10^{-3}$ mol of the following yellow coupler Y-25, 0.03 g of HQ-8 and the dye image color stabilizers dissolved as shown in Table-6.

Layer 2

A layer containing 0.9 g of gelatin and 0.1 g of DOP into which 0.06 g of HQ-8 were dissolved.

Layer 3

A layer containing 1.3 g of gelatin, 0.29 g of a green-sensitive and cubic system silver chlorobromide emulsion (in terms of silver bromide contents at 45 mol% and average grain size of 0.40 μm), 0.010 g of an antirradiation dye (AI-1) and 0.3 g of DOP into which $0.9\times10^{-3}$ mol of the following magenta couplers M-1, 0.2 g of the following color image stabilizer STB-1, 0.05 g of STB-2 and 0.01 g of HQ-8 were dissolved, respectively.

Layer 4

A layer containing 1.6 g of gelatin, 0.015 g of an antiirradiation dye (AI-2) and 0.4 g of DOP into which 0.8 g of UV-1 and 0.2 g of HQ-8 were dissolved.

Layer 5

A layer containing 1.6 g of gelatin, 0.24 g of a red-sensitive and cubic system silver chlorobromide emulsion (in terms of silver bromide contents of 30 mol% and average grain size of 0.33 μm) and 0.4 g of HBSs shown in Table-5, into which $10^{-3}$ mol of cyan coupler C-1, 0.02 g of HQ-8 and an exemplified HP were dissolved, respectively.

Layer 6

A layer containing 1.0 g of gelatin and 0.2 g of DOP into which 0.4 g of UV-1 were dissolved.

Layer 7

A layer containing 1.2 g of gelatin, 0.02 g of polyvinylpyrolidone and 0.09 g of 2,4-dichloro-6-hydroxy-s-triazine.

M-1

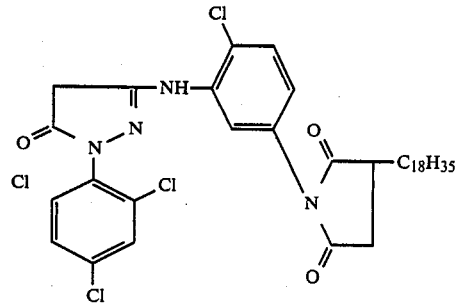

C-1

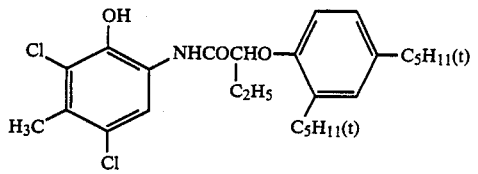

AI-1

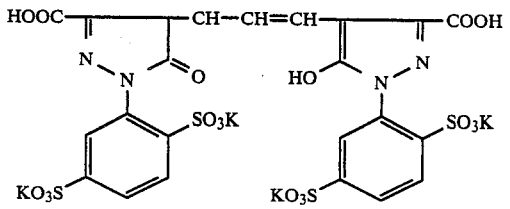

AI-2

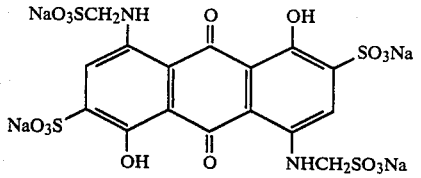

STB-1

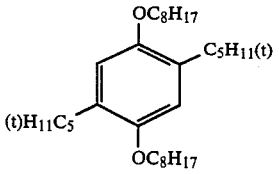

-continued

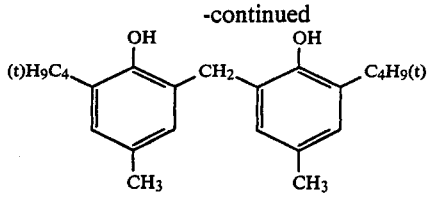

STB-2

The samples prepared were exposed to monochromatic rays of blue light through an optical wedge and were then processed in the same manner as in Example-1, respectively, so that the results were obtained as shown in Table-6.

From the results shown in Table-6, it was found that, even in the examples of multilayered color printing papers, the color fastness against light of yellow dye images can remarkably be improved without any serious deterioration of developability by making use of a color-stabilizer in a relatively less amount, provided that the compounds each represented by the General Formula [I] and color-stabilizers are used in combination.

TABLE 6

| Sample No. | Layer 1 HP or PAP | Layer 1 High boiling organic solvent | Layer 5 HP | Layer 5 High boiling organic solvent | Maximum density I | Maximum density II | Contrast I | Contrast II | Color fastness against light [I] 100 | [I] 200 | [I] 400 | [II] 100 | [II] 200 | [II] 400 | |
|---|---|---|---|---|---|---|---|---|---|---|---|---|---|---|---|
| 81 | — | DNP 0.6 g | — | DOP 0.4 g | 2.65 | 2.46 | 3.24 | 2.96 | 89 | 83 | 62 | 90 | 79 | 61 | Comp. |
| 82 | — | TOP 0.6 g | — | DOP 0.4 g | 2.63 | 2.40 | 3.30 | 3.04 | 88 | 80 | 59 | 88 | 76 | 57 | Comp. |
| 83 | — | [I-4] 0.6 g | — | [I-4] 0.4 g | 2.65 | 2.40 | 3.19 | 2.89 | 92 | 86 | 59 | 93 | 81 | 58 | Inv. |
| 84 | — | [i-24] 0.6 g | — | [i-24] 0.4 g | 2.60 | 2.42 | 3.24 | 2.91 | 93 | 85 | 60 | 92 | 80 | 57 | Inv. |
| 85 | [III-38] 0.2 g | DNP 0.6 g | [III-38] 0.15 g | DOP 0.4 g | 2.56 | 2.26 | 3.07 | 2.74 | 93 | 86 | 69 | 92 | 84 | 66 | Comp. |
| 86 | [III-38] 0.2 g | TOP 0.6 g | [III-38] 0.15 g | DOP 0.4 g | 2.55 | 2.31 | 3.06 | 2.77 | 91 | 84 | 69 | 90 | 82 | 68 | Comp. |
| 87 | [III-38] 0.2 g | [I-4] 0.6 g | [III-38] 0.15 g | [I-4] 0.4 g | 2.57 | 2.30 | 3.11 | 2.80 | 95 | 90 | 79 | 96 | 87 | 77 | Inv. |
| 88 | [III-38] 0.2 g | [I-24] 0.6 g | [III-38] 0.15 g | [I-24] 0.4 g | 2.54 | 2.29 | 3.00 | 2.76 | 96 | 91 | 78 | 95 | 88 | 77 | Inv. |
| 89 | [III-38] 0.2 g | [I-4] (0.4 g) + DBP (0.2) | [III-38] 0.15 g | [I-4] 0.4 g | 2.62 | 2.37 | 3.24 | 2.94 | 95 | 89 | 77 | 95 | 88 | 76 | Inv. |
| 90 | [III-38] 0.4 g | DNP 0.6 g | [III-38] 0.30 g | DOP 0.4 g | 2.50 | 2.24 | 2.85 | 2.61 | 91 | 86 | 73 | 92 | 85 | 71 | Comp. |
| 91 | [III-38 ] 0.4 g | [I-4] 0.6 g | [III-38] 0.30 g | [I-4] 0.4 g | 2.49 | 2.19 | 2.80 | 2.55 | 96 | 91 | 79 | 97 | 90 | 78 | Inv. |
| 92 | [III-38] 0.4 g | [I-24] 0.6 g | [III-38] 0.30 g | [I-24] 0.4 g | 2.51 | 2.21 | 2.76 | 2.43 | 96 | 91 | 80 | 97 | 89 | 79 | Inv. |
| 93 | [IV-19] 0.2 g | DNP 0.6 g | [III-38] 0.30 g | DOP 0.4 g | 2.53 | 2.36 | 2.99 | 2.76 | 93 | 89 | 72 | 93 | 90 | 70 | Comp. |
| 94 | [IV-19] 0.2 g | [I-4] 0.6 g | [III-38] 0.30 g | [I-4] 0.4 g | 2.55 | 2.38 | 3.03 | 2.81 | 96 | 92 | 84 | 97 | 94 | 84 | Inv. |
| 95 | [IV-19] 0.2 g | [I-24] 0.6 g | [III-38] 0.30 g | [I-24] 0.4 g | 2.57 | 2.35 | 3.04 | 2.80 | 97 | 92 | 85 | 97 | 93 | 84 | Inv. |

DNP: Dinonyl phthalate
DBP: Dibutyl phthalate

Example-7

Each of silver halide color photographic light-sensitive materials 101 through 122 was prepared in such a manner that the support made of a sheet of paper having a weight of 170 g/m$^2$ was coated with polyethylene over to one side thereof and with another polyethylene containing an anatase type titanium dioxide in a proportion of 11% by weight to the other side thereof, and each of the resulted polyethylene-coated supports was coated with the following layers in order over to the titanium dioxide containing polyethylene side of the support. Every amount added is expressed herein in terms of sq. meter of light-sensitive materials, unless otherwise specifically stated.)

Layer 1

A layer containing 1.9 g of gelatin, 0.39 g (in terms of silver) of a blue-sensitive silver chlorobromide emulsion, $1.2\times10^{-3}$ mol of the yellow couplers indicated in Table-7, 0.03 g of HQ-11 and 0.50 g of a compound of the invention represented by General Formula [I] and indicated in Table-7 or a high boiling organic solvent (DBP or DNP); and Layer 2

A protective layer containing 1.3 g of gelatin and 0.028 g of sodium 2,4-dichloro-6-hydroxy-s-triazine (i.e., a hardener).

The light-sensitive materials No. 101 through No. 122 each were exposed to white light through an optical wedge and were then processed in the following steps:

| Processing step | Color developer C | Color developer D | Color developer E |
|---|---|---|---|
| Color developing | | | |
| Time | 3 min 30 sec | 2 min | 50 sec |
| Temp | 33° C. | 39° C. | 35° C. |
| Bleach/fixing | 33° C./1 min 30 sec | 33° C./1 min 30 sec | 33° C./1 min 30 sec |
| Washing | 30~34° C./ 2 min | 30~34° C./ 2 min | 30~34° C./ 2 min |
| Drying | 60~80° C./ 2 min | 60~80° C./ 2 min | 60~80° C./ 2 min |

The composition of the processing liquids used therein were as follows:

| Color developer | C | D | E |
|---|---|---|---|
| Pure water | 800 cc | 800 cc | 800 cc |
| Ethylene glycol | 15 | — | — |
| Benzyl alcohol | 15 | — | — |

-continued

| Color developer | C | D | E |
|---|---|---|---|
| Hydroxylamine sulfate | 3.2 g | 3.2 g | 3.2 g |
| Potassium bromide | 0.6 g | 0.6 g | 0.6 g |
| Potassium chloride | 0.3 g | 0.3 g | 0.3 g |
| Potassium sulfite | 2.0 g | 2.0 g | 2.0 g |
| Color developing agent(*1) | 4.5 g | 4.5 g | 10.0 g |
| 1-hydroxyethylidene-1,1-diphosphate | 1.0 g | 1.0 g | 1.0 g |
| Potassium carbonate | 25.0 g | 25.0 g | 30.0 g |
| Whitex BB conc., (a 50% aqueous solution), (made by Sumitomo Chemical Co., Japan) | 1.0 g | 1.0 g | 1.0 g |
| pH(*2) | 10.1 | 10.1 | 11.2 |

(*1)Color developing agent N—ethyl-N—β-methanesulfonamidoethyl-3-methyl-4-aminaniline sulfonate (*2)Each developer was made to 1 liter by adding pure water and the pH value thereof was adjusted with dillute sulfuric acid or potassium hydroxide to be the pH value shown in the above Table.

Bleach-fixer: The same as that in Example-1.

With respect to each of the samples obtained, the reflection densities thereof were measured by making use of monochratic blue-light so as to obtain the respective characteristic curves. From the curves, the maximum densities and contrasts thereof (i.e., the inclination of the reflection densities of from 0.5 to 1.5) were obtained. The results therefrom are shown in Table-7.

Further, with the samples obtained, the color fastness in the dark of the dye images was checked up in the following method.

(Color fastness in the dark)

After storing the samples for 20 days at 70° C. and 60%RH, the rates of each residual dye images thereon and the rates of stains on each white area were checked up at the stage of incipient density of 1.0.

alcohol; and the samples (Sample No. 109 through No. 111) using yellow coupler Y-25 can display each satisfactorily high maximum density and contrast when processing with color developer E having a pH value of 11.2, however, when they are processed with color developer D having a pH value of 10.1, they display only such a color developability as is equivalent to the color developability displayed by Samples No. 101 through 108 when the latter are processed with color developer D. To the contrary, the samples using yellow coupler Y-3 or Y-23 having a —$SO_2$— group, which is preferably used in this invention, may be able to display satisfactorily high maximum density and contrast even when they are processed with color developer D or E each not containing any benzyl alcohol.

From the results of the dark preservability tests, it is understood that, when a sample using yellow couplers each containing a —$SO_2$— group is added by DBP and DNP, there are stains more increased than in the samples using the couplers not containing any —$SO_2$— group even in either processes and, on the other hand, that, when a sample using yellow couplers, which is preferably used in the invention, is further added by the amide type compounds of the invention each represented by General Formula [I], such stains can be inhibited from occurring.

Example-8

The same samples as in Example-7, herein called Samples Nos. 131 through 146, were prepared again, provided however that they were processed only in Processes [C] and [E] and each of the maximum densities, contrasts, color fastness against light (Irradiation time: 100, 200 and 300 hours) and color fastness in the dark of the samples were checked up. The yellow couplers, the compounds represented by General Formula [I] and the exemplified compounds each added into the 1st layer as well as the results obtained are shown in Table-8 below:

TABLE 7

| Sample No. | Yellow coupler | High boiling organic solvent | Maximum density | | | Contrast | | | Dark preservability: Dye residual ratio | | | Dark preservability: Stain | | | Remark |
|---|---|---|---|---|---|---|---|---|---|---|---|---|---|---|---|
| | | | C | D | E | C | D | E | C | D | E | C | D | E | |
| 101 | Y-26 | DBP (*1) | 2.3 | 1.4 | 1.8 | 2.80 | / | 1.42 | 0.94 | 0.92 | 0.92 | 0.07 | 0.07 | 0.06 | Comp. |
| 102 | Y-26 | [I-4] | 2.2 | 1.4 | 1.9 | 2.76 | / | 1.30 | 0.93 | 0.92 | 0.92 | 0.07 | 0.07 | 0.07 | Inv. |
| 103 | Y-26 | [I-8] | 2.2 | 1.3 | 1.9 | 2.81 | / | 1.27 | 0.93 | 0.90 | 0.93 | 0.06 | 0.07 | 0.07 | Inv. |
| 104 | Y-26 | [I-10] | 2.2 | 1.3 | 1.8 | 2.83 | / | 1.46 | 0.93 | 0.92 | 0.92 | 0.07 | 0.06 | 0.07 | Inv. |
| 105 | Y-26 | [I-24] | 2.2 | 1.3 | 1.9 | 2.70 | / | 1.61 | 0.93 | 0.93 | 0.92 | 0.07 | 0.06 | 0.08 | Inv. |
| 106 | Y-37 | DBP | 2.3 | 1.6 | 1.7 | 2.69 | 0.72 | 1.35 | 0.95 | 0.93 | 0.93 | 0.07 | 0.06 | 0.07 | Comp. |
| 107 | Y-37 | [I-4] | 2.2 | 1.4 | 1.6 | 2.68 | / | 1.01 | 0.95 | 0.92 | 0.93 | 0.06 | 0.06 | 0.07 | Inv. |
| 108 | Y-37 | [I-24] | 2.2 | 1.4 | 1.7 | 2.73 | / | 1.24 | 0.94 | 0.93 | 0.92 | 0.06 | 0.07 | 0.07 | Inv. |
| 109 | Y-25 | DBP | 2.1 | 1.6 | 1.9 | 2.87 | 0.65 | 2.41 | 0.87 | 0.85 | 0.83 | 0.07 | 0.08 | 0.09 | Comp. |
| 110 | Y-25 | [I-4] | 2.0 | 1.5 | 1.9 | 2.92 | 0.40 | 2.26 | 0.86 | 0.85 | 0.86 | 0.08 | 0.08 | 0.09 | Inv. |
| 111 | Y-25 | [I-24] | 2.0 | 1.6 | 1.9 | 2.89 | 0.76 | 2.25 | 0.84 | 0.83 | 0.83 | 0.08 | 0.08 | 0.08 | Inv. |
| 112 | Y-3 | DBP | 2.4 | 1.8 | 2.0 | 2.93 | 1.29 | 2.60 | 0.96 | 0.94 | 0.96 | 0.09 | 0.11 | 0.12 | Comp. |
| 113 | Y-3 | DNP (*2) | 2.3 | 1.7 | 1.8 | 2.89 | 1.16 | 1.96 | 0.96 | 0.93 | 0.93 | 0.08 | 0.11 | 0.12 | Comp. |
| 114 | Y-3 | [I-4] | 2.4 | 2.1 | 2.4 | 3.06 | 1.76 | 2.76 | 0.96 | 0.94 | 0.93 | 0.06 | 0.08 | 0.07 | Inv. |
| 115 | Y-3 | [I-8] | 2.3 | 2.2 | 2.4 | 2.96 | 1.88 | 2.91 | 0.96 | 0.93 | 0.93 | 0.06 | 0.08 | 0.07 | Inv. |
| 116 | Y-3 | [I-10] | 2.3 | 2.1 | 2.3 | 2.91 | 1.70 | 2.72 | 0.97 | 0.93 | 0.92 | 0.06 | 0.08 | 0.07 | Inv. |
| 117 | Y-3 | [I-24] | 2.4 | 2.2 | 2.3 | 3.00 | 1.91 | 2.96 | 0.95 | 0.94 | 0.93 | 0.06 | 0.07 | 0.06 | Inv. |
| 118 | Y-23 | DBP | 2.4 | 1.8 | 1.9 | 3.11 | 1.26 | 2.74 | 0.96 | 0.93 | 0.93 | 0.09 | 0.12 | 0.13 | Comp. |
| 119 | Y-23 | DNP | 2.3 | 1.6 | 1.7 | 3.06 | 1.01 | 2.87 | 0.96 | 0.92 | 0.92 | 0.09 | 0.11 | 0.13 | Comp. |
| 120 | Y-23 | [I-4] | 2.4 | 1.9 | 2.4 | 2.95 | 1.40 | 2.86 | 0.96 | 0.94 | 0.92 | 0.06 | 0.07 | 0.06 | Inv. |
| 121 | Y-23 | [I-10] | 2.3 | 2.1 | 2.4 | 2.93 | 1.83 | 2.91 | 0.95 | 0.93 | 0.92 | 0.06 | 0.07 | 0.07 | Inv. |
| 122 | Y-23 | [I-24] | 2.3 | 2.2 | 2.5 | 2.95 | 2.14 | 3.04 | 0.96 | 0.93 | 0.94 | 0.06 | 0.07 | 0.07 | Inv. |

(*1) DBP: Dibutyl phthalate (*2) DNP: dinonyl phthalate

As is obvious from the results shown in Table-7 above, the samples (Sample No. 101 through No. 108) using yellow coupler Y-26 or Y-37 are lowered in both maximum density and contrast more seriously in the case of processing them with color developer D or E not containing any benzyl alcohol than in the case of processing with color developer C containing benzyl

TABLE 8

| Sample No. | Yellow coupler | High boiling organic solvent | HP or PAP | Maximum density C | Maximum density E | Contrast C | Contrast E | Light preservability: Dye residual ratio [C] 100 hrs. | [C] 200 hrs. | [C] 300 hrs. | [E] 100 hrs. | [E] 200 hrs. | [E] 300 hrs. | Stain 300 hrs. C | Stain 300 hrs. E | Dark preservability: Dye residual ratio C | Dye residual ratio E | Stain C | Stain E | Remark |
|---|---|---|---|---|---|---|---|---|---|---|---|---|---|---|---|---|---|---|---|---|
| 131 | Y-3 | DNP | — | 2.3 | 2.1 | 2.90 | 2.81 | 0.92 | 0.85 | 0.78 | 0.90 | 0.83 | 0.70 | 0.04 | 0.04 | 0.95 | 0.92 | 0.13 | 0.14 | Comp. |
| 132 | Y-3 | [I-4] | — | 2.3 | 2.2 | 3.14 | 2.80 | 0.96 | 0.89 | 0.82 | 0.95 | 0.85 | 0.77 | 0.02 | 0.02 | 0.94 | 0.91 | 0.07 | 0.07 | Inv. |
| 133 | Y-3 | [I-4] | (III-36) | 2.2 | 2.1 | 3.06 | 2.72 | 0.97 | 0.92 | 0.89 | 0.96 | 0.91 | 0.88 | 0.01 | 0.02 | 0.94 | 0.92 | 0.07 | 0.07 | Inv. |
| 134 | Y-3 | [I-4] | (III-49) | 2.3 | 2.1 | 3.10 | 2.76 | 0.97 | 0.93 | 0.90 | 0.97 | 0.92 | 0.89 | 0.01 | 0.02 | 0.95 | 0.92 | 0.07 | 0.07 | Inv. |
| 135 | Y-3 | [I-4] | (IV-19) | 2.4 | 2.2 | 3.11 | 2.68 | 0.97 | 0.94 | 0.92 | 0.96 | 0.92 | 0.89 | 0.01 | 0.01 | 0.94 | 0.92 | 0.08 | 0.07 | Inv. |
| 136 | Y-3 | [I-8] | — | 2.3 | 2.1 | 3.20 | 2.76 | 0.95 | 0.88 | 0.80 | 0.95 | 0.86 | 0.76 | 0.01 | 0.01 | 0.94 | 0.91 | 0.09 | 0.08 | Inv. |
| 137 | Y-3 | [I-8] | (III-36) | 2.4 | 2.1 | 3.16 | 2.74 | 0.96 | 0.93 | 0.87 | 0.95 | 0.91 | 0.88 | 0.01 | 0.01 | 0.94 | 0.91 | 0.08 | 0.08 | Inv. |
| 138 | Y-3 | [I-8] | (III-49) | 2.4 | 2.1 | 3.08 | 2.82 | 0.96 | 0.92 | 0.86 | 0.96 | 0.92 | 0.85 | 0.01 | 0.01 | 0.95 | 0.92 | 0.08 | 0.08 | Inv. |
| 139 | Y-3 | [I-8] | (IV-19) | 2.4 | 2.1 | 3.02 | 2.70 | 0.97 | 0.92 | 0.88 | 0.96 | 0.91 | 0.87 | 0.01 | 0.01 | 0.94 | 0.92 | 0.07 | 0.07 | Inv. |
| 140 | Y-22 | DNP | — | 2.4 | 2.2 | 3.16 | 3.02 | 0.90 | 0.84 | 0.77 | 0.89 | 0.81 | 0.70 | 0.03 | 0.03 | 0.97 | 0.93 | 0.12 | 0.12 | Comp. |
| 141 | Y-22 | DNP | (III-36) | 2.5 | 2.3 | 3.02 | 2.95 | 0.92 | 0.88 | 0.84 | 0.91 | 0.84 | 0.73 | 0.03 | 0.03 | 0.96 | 0.93 | 0.12 | 0.12 | Comp. |
| 142 | Y-22 | [I-4] | — | 2.4 | 2.1 | 3.24 | 3.13 | 0.94 | 0.85 | 0.75 | 0.93 | 0.86 | 0.72 | 0.01 | 0.01 | 0.97 | 0.94 | 0.07 | 0.07 | Inv. |
| 143 | Y-22 | [I-4] | (III-36) | 2.4 | 2.2 | 3.16 | 3.02 | 0.96 | 0.90 | 0.86 | 0.95 | 0.89 | 0.84 | 0.01 | 0.01 | 0.97 | 0.95 | 0.06 | 0.06 | Inv. |
| 144 | Y-22 | [I-4] | (IV-19) | 2.5 | 2.2 | 3.19 | 3.09 | 0.95 | 0.91 | 0.88 | 0.94 | 0.90 | 0.86 | 0.01 | 0.01 | 0.97 | 0.93 | 0.07 | 0.06 | Inv. |
| 145 | Y-22 | [I-8] | — | 2.5 | 2.2 | 3.24 | 3.24 | 0.94 | 0.86 | 0.79 | 0.94 | 0.85 | 0.75 | 0.01 | 0.01 | 0.97 | 0.95 | 0.07 | 0.07 | Inv. |
| 146 | Y-22 | [I-8] | (III-36) | 2.4 | 2.2 | 3.21 | 3.12 | 0.96 | 0.90 | 0.84 | 0.96 | 0.89 | 0.82 | 0.01 | 0.01 | 0.97 | 0.95 | 0.06 | 0.06 | Inv. |

As is obvious from the results shown in Table-8, it is understood that the samples to which the amide compounds of the invention are added can display the same effects as those of Example-1 even when a color stabilizer against light is added thereto and, particularly in this example, when comparing the light preservability resulted from the process [C] with that from process [E], the samples each containing a color stabilizer against light and the compound represented by General Formula [I] in combination have almost no difference in the results between the processes taken and can display an excellent dye image stability.

Example-9

Sample No. 131 through 146 were prepared in the same manner as in Example-8, except that a silver chlorobromide emulsion having a silver chloride composition of 99.5 mol% was used as the blue-sensitive silver halide emulsion used in the 1st layer thereof. The resulted color photographic light-sensitive materials were exposed to light through an optical wedge and were then color-developed with the following color developer at 35° C. for 45 seconds and treated with the bleach-fixer described in Example-1 for 45 seconds and, in succession, washed and dried up.

| Color developer [F] | |
|---|---|
| Pure water | 800 ml |
| Triethanolamine | 15 ml |
| N,N—diethyl hydroxylamine | 5 g |
| Potassium sulfite | 0.4 g |
| Potassium chloride | 3.0 g |
| N—ethyl-N—β-methanesulfonamido ethyl-4-aminoaniline sulfate | 5.0 g |
| Potassium carbonate | 27.0 g |
| Whitex BB conc. (a 50% aqueous solution) | 2.0 g |
| Water to be added to make | 1 liter |
| pH to be adjusted to | pH 10.5 |

With respect to the resulted samples, the maximum desities, contrasts, color fastness against light and color fastness against darkness thereof were evaluated in the same manners as in Example-8. The results thereof were similar to those obtained in Example-8.

What is claimed is:

1. A silver halide photographic light-sensitive material comprising a support and, provided thereon, at least one silver halide emulsion layer, wherein said emulsion layer contains at least one of the compounds represented by General Formula [I] and at least one of the yellow couplers represented by General Formula [II]:

General Formula [I]

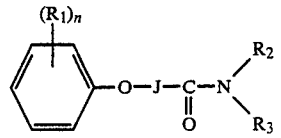

wherein $R_1$ is an alkyl group or an alkoxy group; J is an alkylene group having a straight or branched chain; $R_2$ and $R_3$ are each an alkyl group; and n is an integer of from 1 to 3, in which, when n is 2 or 3, the groups represented by $R_1$ may be the same with or different from each other.

General Formula [II]

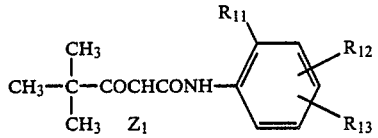

wherein $R_{11}$ is a halogen atom or an alkoxy group; $R_{12}$ is a hydrogen atom, a halogen atom or an alkoxy group; $R_{13}$ is an acylamino group, an alkoxycarbonyl group, an alkylsulfamoyl group, an arylsulfamoyl group, an arylsulfonamido group, an alkylureido group, an arylureido group, a succinimido group, an alkoxy group or an aryloxy group; and $Z_1$ is a hydrogen atom or a group capable of splitting off from a coupler residue upon reaction of the coupler residue with the oxidized products of a color developing agent.

2. The silver halide photographic light-sensitive material of claim 1, wherein said emulsion layer further contains at least one compound selected from the group consisting of the compounds each having a sterically hindered phenol group represented by General Formula [III] and the compounds each having a polyalkylpiperidinyl group represented by General Formula [IV]:

General Formula [III]

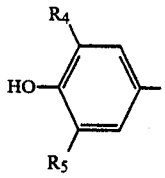

wherein $R_4$ and $R_5$ are each an alkyl group having three to eight carbon atoms.

General Formula [IV]

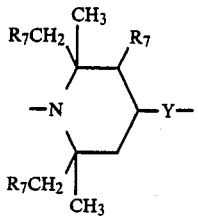

Wherein $R_7$ is a hydrogen atom or an alkyl group; Y is an oxygen atom or $=NR_8$ group; and $R_8$ is a hydrogen atom, an alkyl group or an acyl group.

3. The silver halide photographic light-sensitive material of claim 1, wherein said yellow couplers are represented by General Formula [IIa]:

General Formula [IIa]

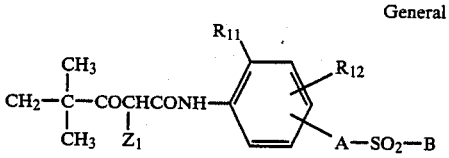

wherein A is a linkage, an $—NR_{13}—$ group, an $—NR_{14}COR_{15}—$ group, an

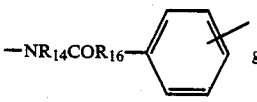

group,

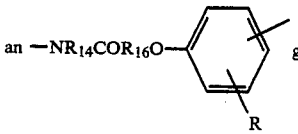

group or

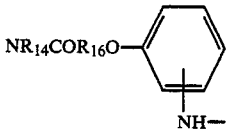

group each in which $R_{14}$ is a hydrogen atom or an alkyl group, $R_{15}$ and $R_{16}$ are each an alkylene group and R is a hydrogen atom or an alkoxycarbonyl group; B is an alkyl group, an aryl group, a heterocyclic group, an arylthio group or

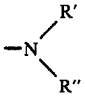

group; and $R_{11}$, $R_{12}$ and $Z_1$ are each the same as those denoted in General Formula [II], in which R is alkoxycarbonyl group and R' and R'' are each a hydrogen atom, an alkyl atom or an acyl group.

4. The silver halide photographic light-sensitive material of claim 3, wherein said yellow couplers are represented by General Formula [IIb]:

General Formula [IIb]

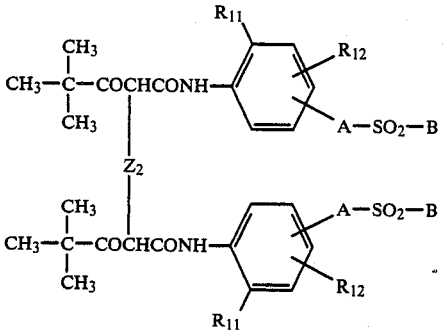

wherein $Z_2$ represents a divalent linking group necessary to couple a two-molecular type pivaloylacetanilido coupler so as to form a bis-type coupler.

5. The silver halide photographic light-sensitive material of claim 1, wherein a content of said yellow coupler in said emulsion layer is within the range of from 0.002 to 1 mol per mol of the silver halide contained in said emulsion layer.

6. The silver halide photographic light-sensitive material of claim 5, wherein a content of said yellow coupler is within the range of from 0.05 to 0.8 mol per mol of the silver halide contained in said emulsion layer.

7. The silver halide photographic light-sensitive material of claim 1, wherein a content of said compound represented by General Formula [I] is within the range of from 5 to 200% by weight to said yellow coupler contained in said emulsion layer.

8. The silver halide photographic light-sensitive material of claim 7, wherein a content of said compound represented by General Formula [I] is within the range of from 10 to 100% by weight to said yellow coupler contained in said emulsion layer.

9. The silver halid photographic light-sensitive material of claim 2, wherein a content of said compound, which is selected from the compounds each having a sterically hindered phenol group and the compounds each having a polyalkylpiperidyl group, is within the range of from 5 to 100% by weight to said yellow coupler contained in said emulsion layer.

10. The silver halide photographic light-sensitive material of claim 9, wherein a content of said compound, which is selected from the compounds each having a sterically hindered phenol group and the compounds each having a polyalkylpiperidyl group, is within the range of from 10 to 70% by weight to said yellow coupler contained in said emulsion layer.

* * * * *